US006680993B2

(12) United States Patent
Satz et al.

(10) Patent No.: US 6,680,993 B2
(45) Date of Patent: Jan. 20, 2004

(54) METHOD OF PRODUCING ACTINIUM-225 AND DAUGHTERS

(76) Inventors: Stanley Satz, 9372 Harding Ave., Surfside, FL (US) 33154; Scott Schenter, 1915 Ocean Front Walk No. 224, Santa Monica, CA (US) 90405

( * ) Notice: Subject to any disclaimer, the term of this patent is extended or adjusted under 35 U.S.C. 154(b) by 0 days.

(21) Appl. No.: 09/725,017

(22) Filed: Nov. 29, 2000

(65) Prior Publication Data

US 2002/0094056 A1 Jul. 18, 2002

Related U.S. Application Data

(60) Provisional application No. 60/167,910, filed on Nov. 30, 1999.

(51) Int. Cl.[7] ..... G21G 1/10

(52) U.S. Cl. ..... 376/156; 376/105; 376/109; 376/115; 376/152; 376/162; 376/195; 376/137; 376/157; 376/159; 376/194; 376/200; 376/202; 376/190

(58) Field of Search ..... 376/156, 157, 376/159, 190, 137, 194, 195, 162, 152, 200, 202, 105, 109, 115

(56) References Cited

U.S. PATENT DOCUMENTS

| | | | | |
|---|---|---|---|---|
| 2,576,600 A | * | 11/1951 | Hanson | 376/109 |
| 2,902,613 A | * | 9/1959 | Baldwin et al. | 376/156 |
| 2,975,113 A | * | 3/1961 | Gordon | 376/180 |
| 3,349,001 A | * | 10/1967 | Stanton | 376/193 |
| 3,594,275 A | * | 7/1971 | Ransohoff et al. | 376/158 |
| 3,639,849 A | * | 2/1972 | Bennett | 376/105 |
| 3,722,338 A | * | 3/1973 | Cherel | 83/278 |
| 3,725,663 A | * | 4/1973 | Mayo et al. | 376/184 |
| 4,088,532 A | | 5/1978 | Blue | 176/11 |
| 4,196,265 A | | 4/1980 | Koprowski et al. | 435/2 |
| 4,835,107 A | | 5/1989 | Horwitz et al. | 436/82 |
| 4,835,433 A | * | 5/1989 | Brown | 310/305 |
| 4,923,985 A | | 5/1990 | Gansow et al. | 540/474 |
| 4,931,270 A | | 6/1990 | Horn et al. | 424/1.1 |

(List continued on next page.)

FOREIGN PATENT DOCUMENTS

| | | | |
|---|---|---|---|
| EP | 0 962 942 A1 | | 12/1999 |
| EP | 0 967 618 A1 | | 12/1999 |
| FR | 2702591 | * | 9/1994 |
| WO | WO 98/09816 | | 5/1993 |
| WO | WO 99/59640 | | 11/1999 |
| WO | WO 99/63550 | | 12/1999 |

OTHER PUBLICATIONS

Steinberg, "Nuclear power without nuclear bombs", New Scientist Jul. 1977, pp. 13–15.*

About–Pirak et al., Efficacy of Antibodies to Epidermal Growth Factor Receptor Against KB Carcinoma In Vitro and in Nude Mice, J. National Cancer Institute, vol. 80, No. 20, pp. 1605–1611 (1988).

Case et al., Separation of Radium and Its Determination by Photon/Electron–Rejecting Alpha Liquid Scintillation Spectrometry, Radioact. Radiochem, vol. 1, No. 58 (1990).

(List continued on next page.)

*Primary Examiner*—Charles T. Jordan
*Assistant Examiner*—John Richardson
(74) *Attorney, Agent, or Firm*—Liebler, Ivey & Connor; Floyd E. Ivey

(57) ABSTRACT

A method of producing an isotope comprising directing electrons at a converting material coated with a coating material, the coating material having an atomic number of n, whereby interaction of the electrons with the converting material produces photons, and whereby the photons produced interact with the coating material to produce an isotope having an atomic number of n–1. In preferred embodiments, the converting material is Tungsten, the coating material having an atomic number of n is Radium-226, and the isotope having an atomic number of n–1 is Radium-225.

24 Claims, 4 Drawing Sheets

U.S. PATENT DOCUMENTS

Figure 1:
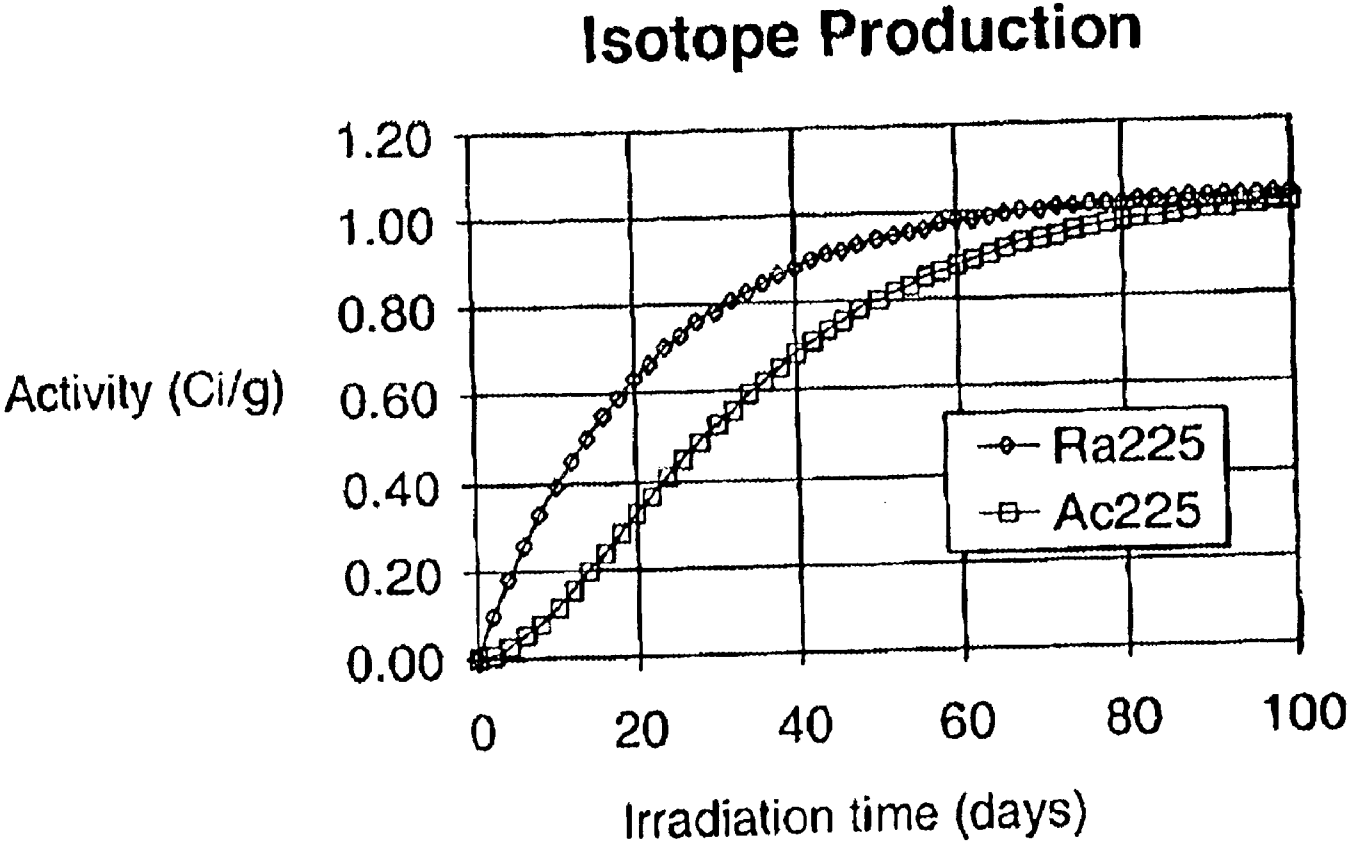

| | | | | | |
|---|---|---|---|---|---|
| 4,943,375 | A | | 7/1990 | Bradshaw et al. | 210/674 |
| 5,124,471 | A | | 6/1992 | Gansow et al. | 558/17 |
| 5,219,556 | A | | 6/1993 | Wolfangel | 424/1.1 |
| 5,264,570 | A | | 11/1993 | Johnson et al. | 536/122 |
| 5,286,850 | A | | 2/1994 | Gansoh et al. | 424/1.45 |
| 5,342,283 | A | * | 8/1994 | Good | 600/8 |
| 5,355,394 | A | | 10/1994 | van Geel et al. | 376/189 |
| 5,364,613 | A | | 11/1994 | Sieving et al. | 424/9 |
| 5,428,154 | A | | 6/1995 | Gansow et al. | 540/465 |
| 5,434,287 | A | | 7/1995 | Gansow et al. | 558/17 |
| 5,436,325 | A | | 7/1995 | Johnson et al. | 536/4.1 |
| 5,457,323 | A | | 10/1995 | Geerlings | 250/432 |
| 5,487,880 | A | | 1/1996 | Taylor et al. | 423/2 |
| 5,749,042 | A | | 5/1998 | Bray et al. | 423/2 |
| 5,784,423 | A | | 7/1998 | Lidsky et al. | 376/156 |
| 5,809,394 | A | | 9/1998 | Bray et al. | 423/3 |
| 5,853,695 | A | | 12/1998 | Srivastava et al. | 424/1.65 |
| 5,854,968 | A | | 12/1998 | Horwitz et al. | 423/2 |
| 5,874,811 | A | | 2/1999 | Finlan et al. | 315/502 |
| 5,949,836 | A | | 9/1999 | Lidsky et al. | 376/156 |
| 5,958,374 | A | | 9/1999 | Meares et al. | 424/1.65 |
| 5,985,124 | A | | 11/1999 | Yoda et al. | 205/118 |
| 6,004,532 | A | | 12/1999 | Srivastava et al. | 424/1.65 |
| 6,103,295 | A | | 8/2000 | Chan et al. | 427/5 |
| 6,442,226 | B1 | * | 8/2002 | Venneri et al. | 376/170 |

OTHER PUBLICATIONS

Chen et al., Tumor Necrosis Treatment of ME–180 Human Cervical Carcinoma Model with $^{131}$I–Labeled TNT–1 Monoclona Antibody, Cancer Research, vol. 49, No. 16, pp. 4578–4585 (1989).

Cox et al, Rates and Equilibria of Alkaline–Earth–Metal Complexes with Diaza Crown Ethers in Methanol, Inorganic Chemistry, vol. 27, pp. 4018–4021 (1988).

Cram et al., Host–Guest Complexation. 36. Spherand and Lithiumand Sodium Ion Complexation Rates and Equilibria, J. Am. Chem. Soc., vol. 107, pp. 3657–3668 (1985).

Cram, D.J., The Design of Molecular Hosts, Guests, and Their Complexes, Science, vol. 240, pp. 760–767 (1988).

Krishnaswami et al., The Simultaneous Determination of Th, Pu, Ra Isotopes, $^{210}$Pb, $^{55}$Fe, $^{32}$Si and $^{14}$C in Marine Suspended Phases, Analyctica Chim. Acta, vol. 83, pp. 143–156 (1976).

McDowell, B.A., et al., The Synergistic Solvent Extraction of Radium From Alkaline Nitrate Media By DicycloHexano–21–Crown–7 Combined With 2–Methyl–2–Heptyl Nonanoic Acid Equilibirum Reactions and Methal Ion Competition, Solvent Extraction and Ion Exch., vol. 7, No. 3, pp. 377–393 (1989).

Mizusawa et al., Synthesis and Antibody–Labeling Studies with the p–Isothiocyanatobenzene Derivatives of 1,2–Dicarba–closo–dodecaborane (12) and the Dodecahydro– 7,8–dicarba–nido–undecaborate(1–) Ion for Neutron–Capture Therapy of Human Cancer. Crystal and Molecular Structure of Cs $^{+}$[nido–7–(p–$C_6H_4$NCS)–9–I–7,8–$C_2B_9H_{11}$], Inorganic Chemistry, vol. 24, pp. 1911–1916 (1985).

Mohite et al., Separation of Barium From Alkaline Earths and Associated Elements By Extraction With Dibenzo–18–Crown–6 From A Picrate Medium, Anlytica Chimica Acta, vol. 206, pp. 363–367 (1988).

Morrison, S.L., Genetically Engineered (Chimeric) Antibodies, Hospital Practice (Office Edition), vol. 24, pp. 65–80 (1989).

Pedersen, C.J., The Discovery of Crown Ethers, Science, vol. 241, pp. 536–540 (1988).

Sugiyama et al., Selective Growth Inhibition of Human Lunger Cancer Cell Lines Bearing a Surface Glycoprotein gp160 by $^{125}$I–labeled Anti–gp160 Monoclonal Antibody, Cancer Research, vol. 48, pp. 2768–2773 (1988).

Tang et al., Enhanced Extraction of Lanthanides with Crown Ether Carboxylic Acids of Increasing Lipophilicity, The Analyst, vol. 114, No. 4, pp. 451–453 (1989).

Wai et al., Separation of Yttrium–90 and Stronthium–90 on Papers Impregnated with Ionizable Crown Ethers, Analytical Chemistry, vol. 62, pp. 2412–2414 (1990).

Xia et al., Preparation of Crown Ethers with Isoxazolyllariats: Homologation of Isoxazole Aldehydes, and A Critical Comparison of Lariat Functional Moieties for Lanthanide Extraction, Heterocycles, vol. 32, No. 4, pp. 711–722 (1991).

Kraus et al., Adsorption of the Elements from Hydrochloric Acid, Proceeding of the International Conference on the Peaceful Uses of Atomic Energy, Nuclear Chemistry and the Effect of Irradiation, held in Geneva, Aug. 8–20, 195, vol. 7, p. 837 (in Russian).

Monoclonal Antibodies, R. H. Kenneth, T. J. McKearn, and K. B. Bechtol Eds, Plenum Press, pp. xv–xxii (1980).

* cited by examiner

METHOD OF PRODUCING ACTINIUM-225 AND DAUGHTERS

PRIORITY INFORMATION

This application claims the benefit of U.S. Provisional Application No. 60/167,910, filed Nov. 30, 1999.

I. BACKGROUND OF THE INVENTION

A. Field of the Invention

The present invention generally relates to processes and methods for producing, isolating, and using radiochemicals. More specifically, the methods and processes of this invention are directed to the preparation of Actinium-225 and daughters having high radiochemical and radionuclidic purity, which may be used for the preparation of alpha-emitting radiopharmaceuticals, in particular, for linkage to therapeutics such as those containing monoclonal antibodies, proteins, peptides, antisense, statin, natural products and hormones. The alpha-emitting radionuclide Actinium-225 and daughters can be used for both therapeutic and diagnostic purposes.

B. Description of Related Art

After cardiovascular disease, cancer is the second leading cause of death in the United States, accounting for one-fifth of the total mortality. Lung, prostate, and colorectal cancer are the leading cancers in men, and women are most frequently plagued by breast, lung and colorectal cancer.

Surgical removal is a frequently used therapeutic approach to treatment, but it is, obviously, invasive. Chemotherapy and radiotherapy have the advantage of being non-invasive, but have the potential disadvantage of being too non-specific. That is, killing of cancer cells is obtained with good success, yet the collateral damage can be serious. In fact, collateral damage is the major side effect of these approaches, and is often the reason patients choose to forego chemotherapy and radiotherapy in favor of surgery.

Generally, these systemic methods rely on differences between the cancer cells and the normal cells for targeting. For example, cancer cells proliferate at a faster rate than normal cells, and this difference has been exploited. The greater rate of proliferation results in a greater rate of uptake of toxic substances, as compared to the rate of uptake for normal cells. Thus, where cell toxins are introduced systemically, cancer cells take up the toxins more rapidly than normal cells, and are thereby killed to a greater extent. Obviously, this is not ideal, as any normal cell death is highly undesirable. However, the killing of normal cells by cancer therapeutic agents is a very real side effect, and as mentioned above, is a major reason patients forgo such therapy.

A number of methods have been used with success to increase the specificity of cancer targeting. These methods frequently take advantage of a some other difference between the cancer cells and the normal cells. Differences that have been exploited with good success are the structural differences between cancer cells and normal cells. These structural differences include cell surface antigens, receptors, or other surface proteins or molecules that are differentially expressed between the types of cells. Any such difference may be exploited.

For example, many tumor cells have an increased number of certain cell surface antigens as compared to normal cells. Targeting agents such as monoclonal antibodies may be used to specifically target and bind to the cell surface antigens on the tumor cells, resulting in the localization and internalization of the therapeutic agents. Specifically, for example, monoclonal antibodies such as the anti-gp160 antibody for human lung cancer (see Sugiyama et al., "Selective Growth Inhibition of Human Lung Cancer Cell Lines Bearing a Surface Glycoprotein gp160 by $^{125}$I-Labeled Anti-gp160 Monoclonal Antibody," Cancer Res. 48:2768–2773 (1988), a "FNT-1" monoclonal antibody for human cervical carcinoma (see Chen et al., "Tumor Necrosis Treatment of ME-180 Human Cervical Carcinoma Model with $^{131}$I-Labeled TNT-1 Monoclonal Antibody," *Cancer Res.* (1989) August 15;49(16):4578–85), and antibodies against the epidermal growth factor receptor for KB carcinoma (see Aboud-Pirak et al., "Efficacy of Antibodies to Epidermal Growth Factor Receptor Against KB Carcinoma In Vitro and in Nude Mice," J. National Cancer Institute 80(20):1605–1611 (1988) have been used to specifically localize tumor cells.

Various radiotherapeutic agents have also been utilized to kill tumor cells including, for example, the beta-emitters Iodine-131, Copper-67, Rhenium-186, and Yttrium-90. Beta-emitters, however, are disadvantageous because of their low specific activity, low linear energy transfer, low dose rates (allowing for cell repair of radiation damage), damage to surrounding normal tissues, and in some cases the lack of an associated imageable photon (e.g., Yttrium-90).

Alpha-emitting radionuclides are much more appropriate toxins and have the potential to more effectively treat disease. Unlike conventional systemic radiation therapy utilizing a gamma-emitter, in cell-directed radiation therapy, targeting agents seek out and attach a radioisotope to targeted cancer cells. The selective cytotoxicity offered by alpha-particle-emitting radionuclide constructs is a result of the high linear energy transfer, at least 100 times more powerful than that delivered by beta-emitting radionuclides, short particle path length (50–80 micrometers), and limited ability of cells to repair damage to DNA.

Because the radiation of alpha-emitting radionuclides only penetrates a few cell lengths in depth, there is much less of the collateral damage to healthy tissues and cells common to chemotherapy and beta- and gamma-emitting radionuclides used for radionuclide therapy. The short penetration distance allows for precise targeting of the cancer cells. Alpha-emitting radionuclides are among the most potent cytotoxic agents known and appear safe in human use.

For example, beta-emitting Iodine-131 (8.02-day half-life) is used for the treatment of non-Hodgkin's Lymphoma, thyroid carcinoma, and other cancers. While the iodine preferentially localizes in the thyroid tissue, this treatment is still problematic because the radionuclide penetrates the tissue to a depth of 10 mm and can cause collateral damage to healthy tissues and cells. When given in sufficient doses to kill 1:91 cancer cells (up to 600 millicuries), Iodine-131 can impair or destroy bone marrow in patients, necessitating a marrow transplant. This is a very dangerous and painful process. Another beta-particle-emitting radioisotope utilized for radionuclide constructs is Yttrium-90, which because of its high energy levels, also deeply penetrates human tissue and can cause collateral damage to healthy cells or organs.

Actinium-225, Bismuth-212, Lead-212, Fermium-255, Terbium-149, Radium-223, Bismuth-213 and Astatine-211 are all alpha-emitting radionuclides that have been proposed for radionuclide therapy. Of these radionuclides, Actinium-225 (5.8 MeV alpha-emitter with a 10-day half-life) and its daughter, Bismuth-213 (46-minute half-life) may be the most efficacious. Alpha-emitting Astatine-211 also has been proposed as an appropriate alpha-emitting medical radionuclide, but would be less useful due to its short half-life (7.21 hours), which could create distribution problems.

Bismuth-213 has a shorter half-life than Actinium-225, but its physical and biochemical characteristics, its production, and its radiopharmacological characteristics, make it a good candidate for use in humans. Dr. Otto Gansow pioneered the development of alpha radioimmunotherapy, developing the linkers used to bind the monoclonal antibody to radiobismuth. (See U.S. Pat. Nos. 4,923,985, 5,286,850, 5,124,471, 5,428,154 and 5,434,287 to Gansow et al.) The alpha-emitting radioisotope Bismuth-213, in conjunction with targeting molecules, is showing promise in clinical trials using Bismuth-213 in alpha-radioimmunotherapy.

Bismuth-213 is currently being evaluated in a clinical trial for treatment of Acute Myeloblastic Leukemia (AML) and could have the potential for treatment of a range of diseases including T-Cell leukemia, non-Hodgkins lymphoma, the micrometastases associated with a range of diseases including prostate cancer, and other diseases. It has been found that Bismuth-213 could be used to halt the arteriole growth that feeds solid tumors and lung cancers. This therapy, currently used for the treatment of liquid tumors, such as leukemia, may also be useful in patients to treat solid tumors and certain other diseases, immune disorders, rheumatoid arthritis, degenerative joint diseases, and other disorders such as Kaposi's sarcoma, an AIDS-related infectious disease. Cell-directed radiation therapy, utilizing powerful alpha-emitters for precise targeting of cancer cells, has the potential to minimize the adverse side effects associated with traditional chemotherapy or standard radiation treatments (nausea, hair loss, constipation, dry mouth, insomnia, and vomiting), potentially resulting in a preferred alternative form of disease management. Patients could be treated on an outpatient basis and the doses required would be much less than those for a beta-emitter.

Some methods for producing Actinium-225 are very dangerous, and have low yields. Using one method, Actinium-225 has been produced by the U.S. Department of Energy by extraction from long-lived (7,300 year half-life) Thorium-229. Thorium-229 is very carefully extracted in minute quantities from fissile Uranium-233, a nuclear weapons grade material produced 20–30 years ago during the Cold War from natural Thorium. For example, 5 kilograms of Uranium-233 (enough to produce 1 atomic bomb) yields only 0.5 grams of Thorium-229, or 0.1 Curies. This is only enough to treat about 10 patients. This very costly production technology, utilizing a Thorium-229 "cow" as an Actinium-225 generator, results in low yields of Actinium-225 because the supply of old Thorium-229 and Uranium-233 containing the extractable Thorium-229 is limited.

Even if all of the recoverable Thorium-229 in the United States that could be extracted from existing stocks of Uranium-233 were utilized, only a small amount of Actinium-225, estimated at no more than 3 curies, could be produced each month. This quantity of radionuclide is insufficient for even a number of small clinical trials and would only enable the treatment of a handful of patients who could afford the current high price charged by the U.S. Department of Energy for this radioisotope. The quantity of radioisotope required would cost in the tens of thousands of dollars.

U.S. Pat. No. 5,355,394 discloses another method for the production of effective amounts of Actinium-225 and Bismuth-213 by a very high thermal neutron flux in a nuclear reactor. However, according to the patent, years of continuous irradiation of Radium-226 in a large nuclear reactor would be necessary to produce effective amounts of Thorium-229 starting material. Thus, this process would be very slow. Another disadvantage of this production technique is that large quantities of inseparable Thorium-228 will also be produced.

This undesirable radioisotope, Thorium-228, though shorter lived, is a powerful, deeply penetrating gamma-emitter that can cause collateral damage to healthy tissues and would require a costly "hot cell," isolation of the patient, and considerable shielding at the medical facility where it is utilized. The Thorium-228 and 229 radioisotopes would be intimately mixed together, and it would require about 20 years in storage to decay out the Thorium-228. This would require considerable lead shielding wherever used, and would generate a great deal of radioactive waste and radon gas.

In U.S. Pat. No. 5,457,323, another method is disclosed for production of Actinium-225. This method produces radon gas, a long-lived radioactive gas, which is difficult and expensive to dispose of.

WO 99/63550 discloses another method for producing Actinium-225 from Radium-226, which involves irradiating Radium-226 with protons to produce Actinium-225. A major drawback of this method, however, is the need for a cyclotron for accelerating protons.

Thus, the major problem confronting clinicians and researchers around the world desiring to use the powerful, short lived radionuclide Actinium-225 and its Bismuth-213 daughter for treatment of cancers and other diseases is the extremely limited availability of Actinium-225 in quantities sufficient to use in clinics and for research. In addition, because of the high cost of the radionuclide, its widespread use is not currently feasible.

There is, therefore, a need in the art for new methods of production of Actinium-225.

II. SUMMARY OF THE INVENTION

A. Features and Advantages

This invention provides a method for the ample production of Actinium-225. Materials manufactured according to the invention are particularly useful in radioimmunotherapy to treat cancers, metastases, and micrometastases distant from the primary site.

The invention also provides a method for producing Actinium-225 at levels appropriate for commercial sales, either as a precursor, a labeled pharmaceutical, or as a coating.

The present invention provides a cost-effective method of producing large quantities of Actinium-225 which is safe and dependable, and that does not generate appreciable quantities of radioactive waste. The method also produces Actinium-225 with consistent radiochemical and radionuclidic purity.

This invention provides a reliable method for obtaining greater than 1000-millicurie quantities of Actinium-225/Bismuth-213 in <5-$\mu$Ci Radium-225/100 $\mu$Ci Actinium-225 radionuclide purity via bombardment of Radium-226. The Actinium-225/Bismuth-213 has physical properties that are useful for diagnostic and therapeutic radiopharmaceuticals, particularly when used for radioimmunotherapy.

B. Summary of the Invention

The features and advantages of the present invention are provided by specific embodiments of the present invention.

Such embodiments include methods of producing an isotope comprising directing electrons at a converting material coated with a coating material, the coating material having an atomic number of n; whereby interaction of the electrons with the converting material produces photons, and whereby the photons produced interact with the coating material to produce an isotope having an atomic number of n−1.

In one embodiment, n is 226, and the coating material has an atomic number of n is Radium-226. In this embodiment, n−1 is 225, and the isotope having an atomic number of n−1 is Radium-225. The converting material may comprise Copper, Tungsten, Platinum and/or Tantalum. The converting material may be coated with the coating material using an electroplating procedure. The converting material may be electroplated with Nickel before being electroplated with Radium-226. Alternatively, the converting material may be electroplated with Nickel and Radium-226 simultaneously. The Radium-226 may be coated onto the converting material at a concentration of from about 80 $mg/cm^2$ to about 160 $mg/cm^2$.

In a method of the present invention, the electrons may be directed at the converting material coated with the coating material using an electron accelerator, wherein the electrons are in a beam. The converting material may have a thickness of from about 0.5 mm to about 1.7 mm, and the electron beam may have a current of from about 100 microampere to about 1000 microampere. The electrons may have an energy of from about 20 MeV to about 25 MeV, and the photons may have an energy of from about 10 MeV to about 25 MeV.

A method of the present invention may further include separating Actinium-225 from Radium-225 and Radium-226 using a chemical separation process.

One method of the present invention involves producing an isotope comprising directing electrons at a Tungsten plate that is electroplated with Radium-226, whereby interaction of the electrons with the Tungsten produces photons, and whereby the photons produced interact with the Radium-226 to produce Radium-225.

Other embodiments of the present invention include a target for an electron beam of an electron accelerator comprising a metal plate electroplated with Radium-226. The metal plate may have an atomic number of 30 or higher, and the metal may be selected from Tungsten, Tantalum, Platinum, and/or Copper.

The present invention also provides a metal plate coated with mixture of Radium-226 and Radium-225 and Actinium-225. The metal plate may be selected from Tungsten, Tantalum, Platinum, and Copper.

Other advantages and features of this invention will become apparent to those skilled in the art after reviewing the following technical description and additional embodiments of the present invention set forth below.

III. BRIEF DESCRIPTION OF THE DRAWINGS

FIG. 1: Production activities of Radium-225 and Actinium-225 are shown as a function of irradiation time for a 1.0 g Radium-226 target and a 25MeV electron beam.

Figure 2:
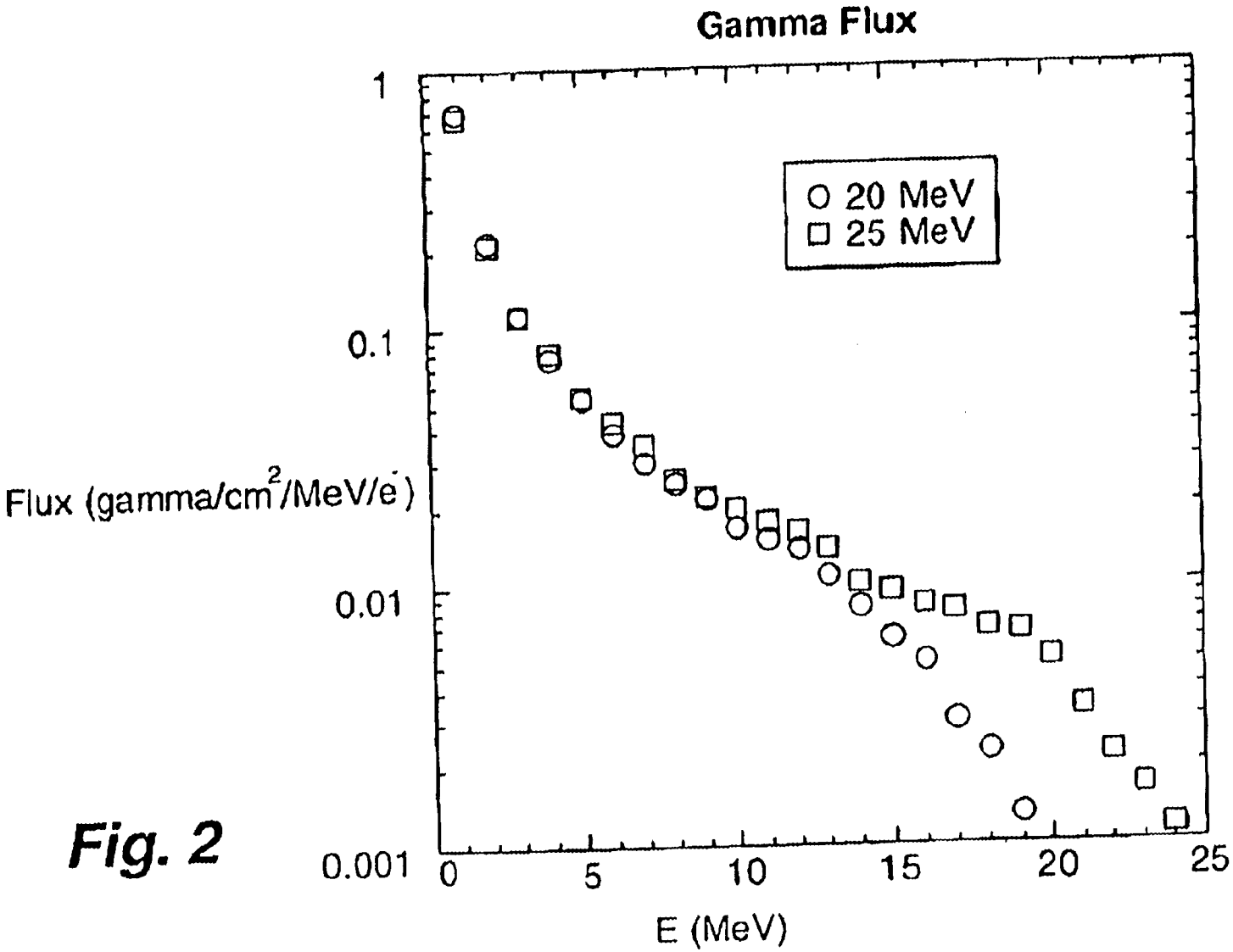

FIG. 2: Gamma flux/spectra produced by both 20 MeV and 25 MeV electrons are shown as a function of energy (MeV). This curve is calculated from the data in Table 1.

Figure 3:
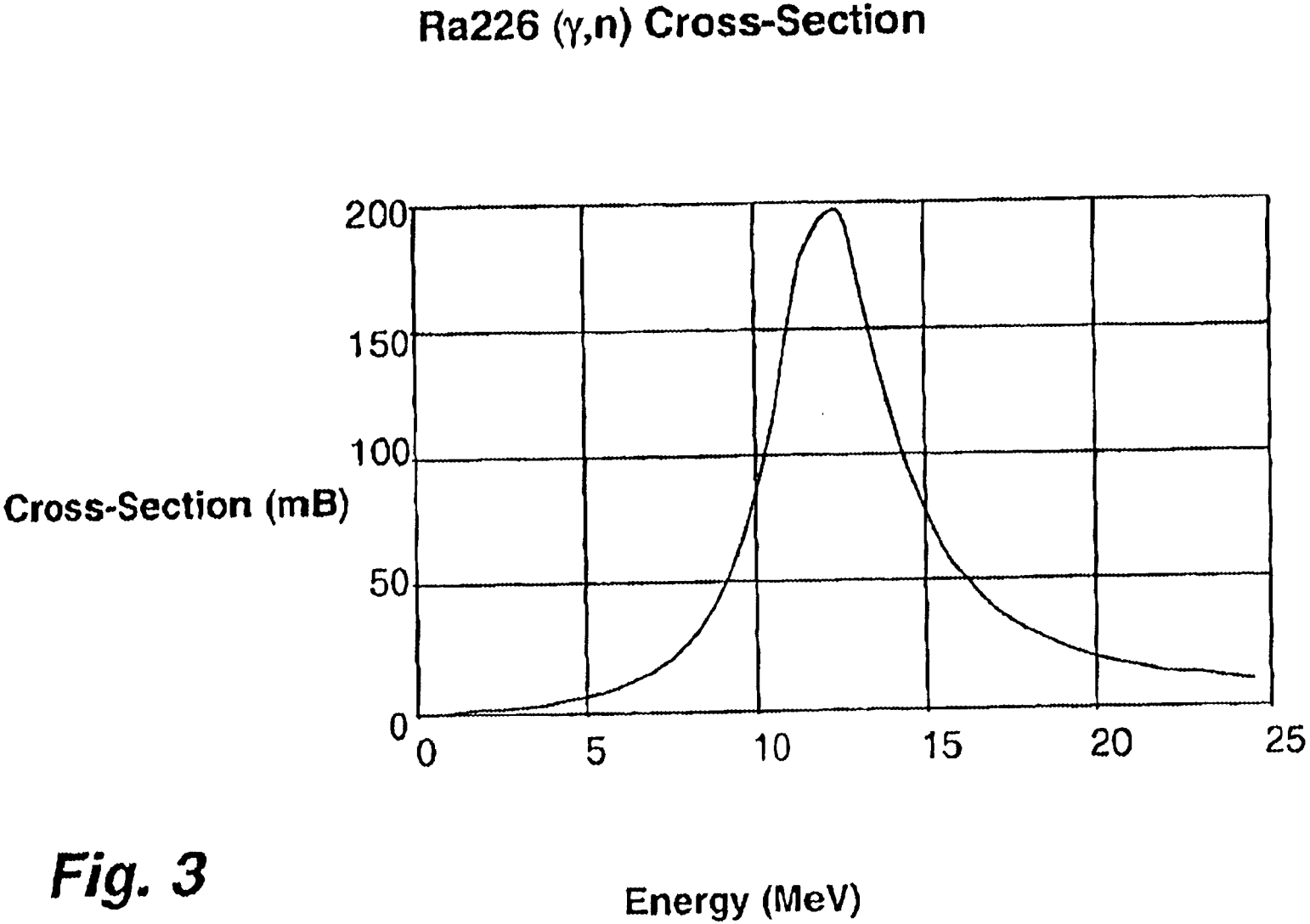

FIG. 3: The Radium-226 (gamma,n) cross section curve is shown as a function of energy (MeV).

Figure 4:
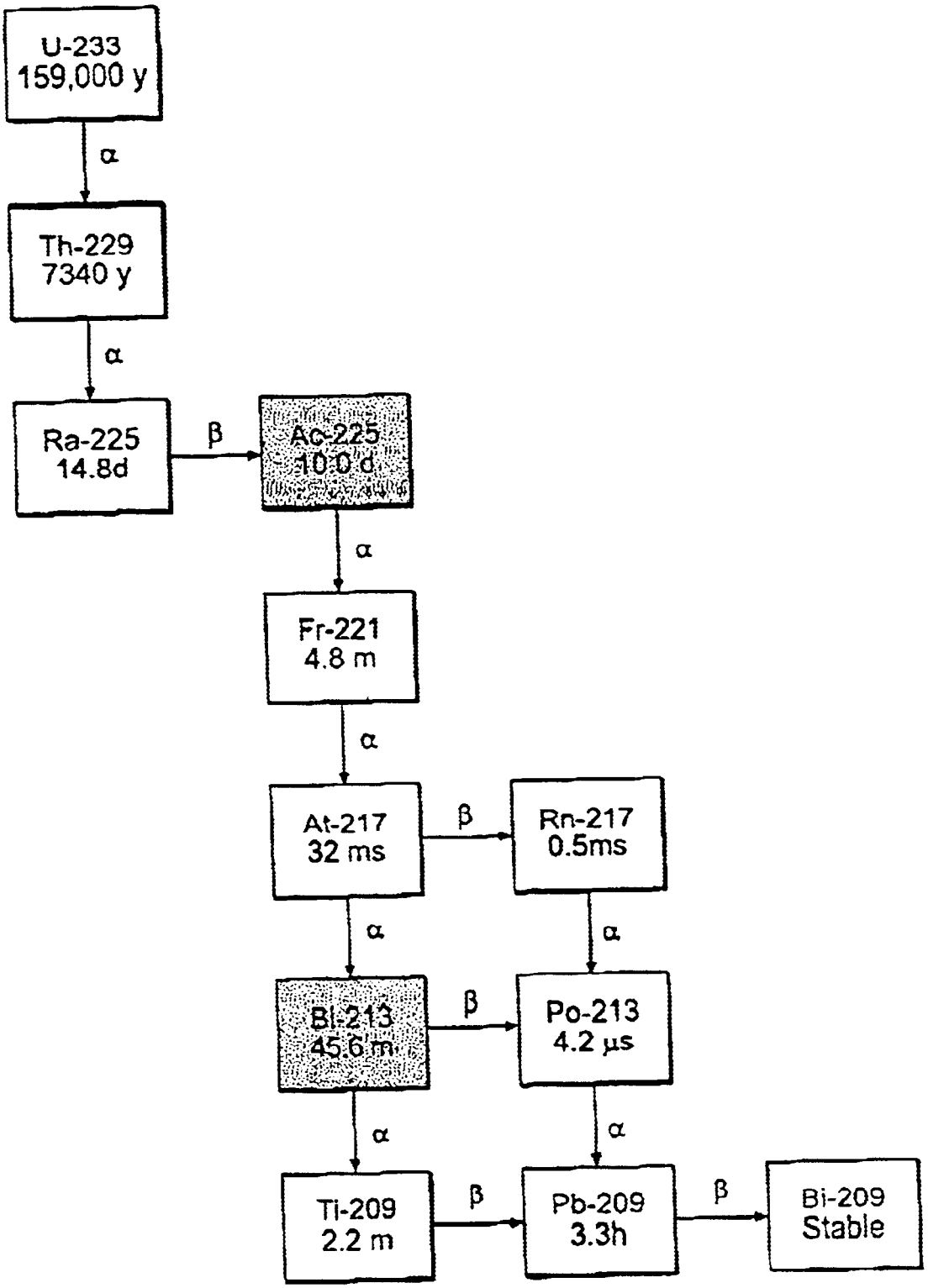

FIG. 4: The radioactive decay of Uranium-233 to Actinium-225 and Bismuth-213 is illustrated.

IV. DETAILED DESCRIPTION OF THE INVENTION

The present invention is directed to the production of radiochemicals. In particular, the invention is directed to the production of Actinium-225 using Radium-226 as a starting material. The invention generally involves irradiating Radium-226, to produce Radium-225, which then undergoes a beta decay to Actinium-225. Actinium-225 can be used to produce its daughter, Bismuth-213. The Actinium-225 product of the present invention may be produced in an amount of about 5 mCi Radium-225 per 100 mCi Actinium-225.

It should be noted that the present invention involves the use of Radium-226, which is the naturally occurring isotope of Radium, having a half-life of 1600 years. Thus, when the term Radium-226 is used throughout the specification, it may be considered that Radium having a natural isotopic abundance is being used. Thus, reference to Radium-226 as a starting material is not meant to imply an isotopically pure form of Radium-226.

A. Preparation of Radionuclides

1. Actinium-225

The invention generally involves the conversion of Radium-226 to Radium-225, using high-energy photons to drive the conversion. This reaction can be described as a photodisintegration reaction. Radium-225 decays to Actinium-225, which is then separated using a chemical separation process.

a. Theory

The reaction for the conversion of Radium-226 to Radium-225 is a photodisintegration reaction, where absorption of high-energy electromagnetic radiation in the form of gamma-ray photons causes a Radium-226 nucleus to eject a neutron, resulting in the formation of Radium-225. This reaction will be referred to herein as a "gamma,n" or "γ,n" reaction, where "n" refers to the neutron ejected.

The high-energy photons are generated by bombarding a converting material with high-energy electrons. The converting material is a material that gives off high-energy photons upon bombardment, and it should be a material that is refractory to the electron bombardment. Examples of such materials include Tungsten, Tantalum, Platinum, and Copper.

The high-energy electrons used to bombard the converting material need to be of sufficient energy so that the photons produced are of sufficient energy to drive the photodisintegration reaction. The energy necessary for the photodisintegration is an energy level that is at least equal to the threshold (minimum) energy level of the giant resonance region of the cross-section versus energy curve for the isotopic conversion reaction. (Giant resonances are the energy average of the compound nucleus resonances of the compound system. These resonances have widths on the order of 1 MeV, and can be derived from the Kapur-Peierls theory of the scattering of a single neutron by a potential.) This is the energy necessary to produce the desired reaction between a photon and the Radium-226.

The intensity of high-energy photons generated by the converting material is proportional to the power density (PD) of the electron beam in the converting material. Power density is calculated according to the following equation:

$$PD=Exi/V$$

where E is the energy of the electron beam, i is the current of the electron beam, and V is the volume of convertor through which the electron beam passes.

While the minimum energy is governed by the threshold energy level of the giant resonance region, the maximum energy is governed by the converting material. That is, the converting material is going limit the energy which can be put into the system. For example, the energy of the high-energy electrons should be balanced against the ability of the converting material to absorb the energy. The energy of the beam should be sufficient to generate photon energy in a range suitable to convert the isotope, yet not be so great that a large percentage of electron beam energy passes through the converting material.

Similarly, if the converting material is too thick, photons will be degraded as they pass through the material. Thus, the preferred thickness of the converting material depends on the electron beam energy, the composition of the converting material, and the giant resonance region threshold energy of Radium-226.

b. Preparation of a Solid Target

In one embodiment of the invention, the Radium-226 is coated onto the converting material. Thus, the as the converting material is bombarded with high-energy electrons, high-energy photons are produced. The high-energy photons then impact the Radium-226 coating on the converting material.

i. Converting Material

In the method of the present invention, the converting material serves the role of converting high-energy electrons into high-energy photons. Thus, any material which has this capacity may be used for this purpose, provided that Radium-226 may be coated onto it. Such materials are described as "convertor" materials in U.S. Pat. No. 5,949,836, to Lidsky et al.

The converting material may be any material that exhibits the desired converting properties, is relatively refractory to the process, and may be electroplated. The converting material may have an atomic number higher than about 30. Examples of converting materials include, but are not limited to, Copper, Tungsten, Platinum and Tantalum. The converting material may be a metal plate, which may be milled, lapped, sanded, washed with distilled water, and dried. The converting material generally will have a thickness of from about 0.5 mm to about 1.7 mm, or a thickness of from about 0.8 mm to about 1.2 mm, or about 1 mm.

ii. Coating a Converting Material with Radium-226

As noted above, the converting material is coated with the radioisotope, e.g., Radium-226, for the reaction. This coating may be performed by electroplating of the radioisotope onto the converting material. The radioisotope coated onto the coating material comprises Radium-226, which forms Radium-226 dioxide upon exposure to air.

Electroplating of Radium-226 onto the converting material may be performed using a Platinum electrode, although other types of electrodes may be used. Thus, electroplating may be performed using a Platinum electrode in a Radium-226 solution, which may be prepared by dissolving Radium-226 in a basic alkali metal hydroxide solution. Examples of alkali metal hydroxides include, but are not limited to, sodium hydroxide and potassium hydroxide.

In an alternative embodiment, an electroplating metal substrate (converting material), such as a Copper, Tungsten, or Tantalum plate, is placed into a nickel-plating solution and the metal substrate is electroplated with nickel. Nickel-plating may be performed using a Watts nickel bath procedure. Briefly, this technique involves operating at a temperature of about 30–60° C., usually with air agitation, and at a pH of about 3.5 to 5.0. Current density is usually from about 2 to 7 A/dm$^2$. The bath composition includes nickel chloride (40–60 g/l), nickel sulfate (240–300 g/l), and boric acid (25–40 g/l). Alternatively, the nickel plating may be performed using the method described by Yoda et al., in U.S. Pat. No. 5,985,124.

The resulting nickel-plated substrate is then placed into a Radium-226 dioxide plating solution and electroplated with Radium-226. This procedure is described briefly as follows.

Sufficient Radium-226 is dissolved in 8 molar $NHO_3$ to form a 0.1 M Radium-226 solution. Cells for electroplating are constructed according to Krishnaswami and Sarin, (Krishnaswami, S., and M. M. Sarin (1976), Anal. Chim. Acta, 83, 143–156). A teflon stir bar is placed in the electroplating device. Limiting values of the power supply are set to 6 V and 0.8 A.

The device is placed on a stir plate in a fume hood. Stirring is started, and the power supply is current limited to 0.8 A. When sufficient plating has occurred, the plating should be terminated by disconnecting the power and adding concentrated ammonia. The electroplated target should be rinsed with distilled water and dried before proceeding.

Alternatively, the converting material may be placed into a plating solution containing both nickel and Radium-226. The nickel and Radium-226 are then electroplated onto the converting material.

In another embodiment, Radium Bromide or Radium Oxide may be mixed in a varnish and painted onto the converting material plate, using processes developed for production of Radium watch dials. In still other embodiments, the Radium may be plated onto the converting material using a method described by Chan et al. in U.S. Pat. No. 6,103,295, "Method of affixing radioisotopes onto a surface of a device."

Regardless of the process chosen, the Radium-226 may be coated onto the substrate until a concentration of at least about 80 mg/cm$^2$ is achieved. In fact, the concentration of Radium-226 may range from about 80 mg/cm$^2$ to about 160 mg/cm$^2$. However, the concentration may be lower or higher, depending on other factors, including energy of the electron beam.

The coating may be performed in a manner that leaves a portion of the converting material exposed for contact with the electron beam. This may be achieved by pouring a spot of molten plastic having a high melting point onto the plate, and allowing it to harden prior to immersing the plate in the bath. The electroplating will then take place around the plastic spot. The plastic spot can be later removed, leaving an uncoated portion.

Regardless of how the Radium-226 target is prepared, the Radium-226-coated converting material is ready for irradiation in accordance with the invention.

c. Preparation of a Liquid Target

In another embodiment, Radium-226 in solution may be converted using the present invention. The Radium-226 solution may comprise Radium-226 chloride, and may be in a concentration of from about 0.5 to about 1.5 molar, or about 0.75 to about 1.25 molar, or about 1 molar. In this embodiment, the solution of Radium-226 may be contained or uncontained.

For example, an uncontained solution of Radium-226 may be flowed over a converting material. Samples of the material flowing off the converting material may be regularly sampled, and the solution may be recycled until sufficient product is produced.

A target solution of Radium-226 may also be used in a contained form. For example, a solution of Radium-226 may be placed in a quartz vial. The solution may be stirred or unstirred. A beam of electrons is then targeted at a converting material, and the photons produced thereby are targeted at the quartz vial of Radium-226 solution. In this manner, a photodisintegration reaction occurs.

There are a number of advantages to the use of a liquid target. In particular, it is advantageous that the product is already in solution. That is, a separate step for isolating solid product from solid reactant is not necessary. In this embodiment, the product may easily be separated by chromatographic separation. Steps for such separation are detailed below.

d. Electron Bombardment

Irradiating of the target is performed using an electron beam, which may be provided by an electron accelerator, and in particular, a linear accelerator.

For a converting material having thickness of about 1 mm, the electron beam that is used should have a current of from about 100 to about 1000 microampere. Alternatively, the current may range from about 250 to about 750 microampere, and may be about 500 microampere. The electron beam may be continuous energy, or may be pulsed.

Usually, the energy of the electron beam is about 2 to 3 times the energy level of the peak of the giant resonance region of the targeted isotope. For example, for the (gamma, n) isotopic conversion of Radium-226 to Radium-225, a significant portion of the of high-energy photons will have energy levels falling within the giant resonance region for this reaction, specifically from about 10 MeV to about 25 MeV, or about 15 MeV. Thus, the electron energy that impacts the converting material is from about 20 MeV to about 25 MeV.

The high-energy electron bombardment is performed for a period of time sufficient to obtain the desired quantities of product. Generally, that period is from about 10 days to about 30 days, or from about 18 days to about 23 days. In one embodiment, the bombardment period is about 20 days. However, the period is dependent on a number of factors, including the electron beam energy (higher energy—less time; less energy—more time), the converting material (greater production of photons—less time; fewer photons—more time), the thickness of the converting material (too thin—electrons pass through—inefficient conversion—more time; too thick—photons not efficiently produced—more time), and the concentration of the coating material (less material to photodisintegrate—less time; more material—more time).

Ideally, the period should not be excessively long. Therefore, the efficiency of the reaction should be maximized to shorten the reaction. As a general rule, which may be applied to the production of other radioisotopes, the reaction should proceed for a period of time that is about 3 times the half-life of the product, or to approximately 80–90% of the maximum production capacity.

Generally, one consideration is that the conversion of high-energy electrons into high-energy photons creates a great deal of heat in the converting material. The heat generated can be so great as to limit the rate the reaction can be performed. Thus, one can optionally include a mechanism for cooling the target, i.e., the coated converting material, during the reaction.

The cooling mechanism may rely on radiative, conductive, or convective dissipation of the heat, and the mechanism may allow dissipation in, around, or through the target. Thus, for example, the target may be formed with channels therein, to allow passage of a coolant through the target; it may be solid, with coolant surrounding; or the target may be porous, to allow the coolant to flow into the interstices of the target. Suitable fluid coolants include liquids, such as water, or liquid gallium, and gases, such as helium.

Liquid targets may be cooled by freezing prior to bombardment, or may be cooled by having a cooling coil submersed in or adjacent to the liquid target. Alternatively, the liquid target may be circulated through a cooling apparatus, such as heat exchanger. In still other embodiments, a liquid target is cascaded over a cooled converting material, which is bombarded by electrons.

e. Separation of Products from Reactants

Radium-225 decays by emission of a beta particle to Actinium-225. When sufficient Actinium-225 is produced by decay, it may be separated from the other materials by chemical separation techniques.

In one embodiment, the irradiated Radium-226 and Radium-225 are dissolved from the target plate by means of an alkali metal hydroxide solution, such as sodium hydroxide solution (5 M), containing equal volumes of 30-$H_2O_2$, plus sufficient de-ionized is $H_2O$ to cover the target. Following dissolution, the solution containing the dissolved materials is then transferred to a vessel containing aluminum powder and then optionally purged with air. The Actinium-225 may then be chemically isolated and separated from the target. For example, after the final volume is adjusted to specific needs, the Actinium-225 is passed through a fine glass filter. The precipitated Radium-225 is retained in the filter.

In some embodiments, all of the Radium and Actinium bound to the converting material is dissolved at once. This leaves a solution of both Actinium and Radium which must be separated. A liquid target would also be in this form, i.e., with a combination of dissolved Actinium and Radium.

Briefly, the Actinium/Radium separation process involves dissolving a (dried) sample containing Actinium-225 and Radium-225 in 0.03M $HNO_3$. The dissolved sample is passed over an ion exchange column designed for separating radiochemicals, for example, an LN® resin column (Eichrom Industries, Inc., Darien, Ill.). Radium-225 and Radium-226 pass through with the effluent, and remaining Radium can be additionally washed from the column with 0.03M $HNO_3$. Bound Actinium-225 is eluted from the column with 0.35M $HNO_3$. Of course, although a column is described here, the method would be applicable to batch, or other methods as well.

In another alternative, separation of Actinium-225 from Radium-226 and Radium-225 may be achieved by crystallization of Radium Nitrate, wherein the supernatant contains the soluble Actinium. For example, Actinium possesses the same 2s,1d outer electron structure as Lanthanum and Yttrium. It possesses a slightly larger ionic radius than Lanthanum; otherwise its chemistry is very similar. The basis for Actinium-225 separation from Radium is an anion separation in which the $HNO_3$ concentration of the Radium feed is adjusted to 5 M and Radium is loaded onto an ion resin column. Trivalent Iron, Chromium, and all divalent and monovalent ions pass through. The Actinium-225 follows with a slight delay. The Actinium-225 is collected separately from the contaminants. The Radium-225 and Radium-226 is stripped from the column with 0.35 M $HNO_3$ and is retained for reuse in target fabrication.

Isolated Actinium-225 may then be purified by an oxalate precipitation followed by cation exchange. Briefly, the Actinium-225 is precipitated as an oxalate by the addition of an oxalic acid solution. Filtration is performed and the supernatant discarded. Oxalates are then destroyed by boiling concentrated $HNO_3$ and $HClO_4$, taking to fumes of $HClO_4$. The Actinium-225 is then taken up in 2 M HCl and loaded on a cation exchange column. The column is washed with 1 bed volume of HCl. Any remaining divalent ions are eluted with 3 bed volumes of 3 M $HNO_3$. Actinium is eluted with 5 bed volumes of 6 M $HNO_3$.

Separation of Radium-225 from Actinium-225 is described in U.S. Pat. No. 5,809,394, to Bray et al.

2. Bismuth-213 a. Theory

As Bismuth-213 is considered a "daughter" of Actinium-225, it also may be produced in accordance with the present invention. The radioactive decay chain in which Bismuth-213 is found is well known: Uranium-233 ($t_{1/2}$=1.62×$10^5$ yr)→Thorium-229 ($t_{1/2}$=7,300 yr)→Radium-225 ($t_{1/2}$=14.8 day)→Actinium-225 ($t_{1/2}$=10 day)→bismuth-213 ($t_{1/2}$=46 min). FIG. 4 shows the complete decay chain of Uranium-233 to Actinium-225 to Bismuth-213.

b. Elution, Separation and Purification

Bismuth-213 may be produced through the radioactive decay of Actinium, using Actinium as a "cow." Bismuth-213 produced may be separated through the use of an organic anion exchange resin to adsorb Bismuth-213 from other materials present. The ability to extract bismuth as an anion as a function of HCl concentration is well known and is described in Kraus, K. A. and F. Nelson, 1955, Proceedings of the International Conference on the Peaceful Uses of Atomic Energy, Nuclear Chemistry and the Effect of Irradiation, Vol. VII, P/837, "Adsorption of the elements from hydrochloric acid," held in Geneva, August 8–20, 1955.

The distribution for the bismuth chloride complex anion in HCl increases with decreasing acid concentration. Other chelator interfering ions of interest, i.e., rare earths, Radium and Actinium, do not extract as chloride anions using anion exchange resin. Therefore, the use of the anion exchange resin allows Bismuth-213 to be effectively removed from these and other ions which do not extract as chloride anions using an anion exchange resin.

The separation of Bismuth-213 from other materials is described, for example, in U.S. Pat. No. 5,749,042, to Bray et al.; in "An improved Generator for the Production of Bi-213," by Wu et al., American Chemical Society Meeting (1996); and in "Generator System Development of Ra-223, Bi-212, and Bi-214 Therapeutic Alpha-Emitting Radionuclides," by Ramirez et al., American Chemical Society Meeting (1996).

B. Use of Radionuclides Produced According to the Invention

Actinium-225 produced in accordance with this invention is produced in sufficient production yield and radiochemical and radionuclidic purity that it is especially suited to a number of uses. For example, it is especially suited for medical uses, including, but not limited to, radioimmunotherapy, radiation therapy and for the detection of metastatic disease, such as with an intraoperative probe for detection of occult cancers. Medical applications for the radionuclides of the present invention include their use in radiopharmaceuticals and/or radiochemicals, as those terms are known in the art. Non-medical uses include the use as a standard, or as a tracer.

1. Use Alone (in "neat" Form)

In medical uses, the radionuclide may be used alone, or it may be linked to another material. Examples of applications in which the radionuclide is used alone include medical imaging, radiation synovectomy, etc.

For example, Actinium-225, Bismuth-213, or mixtures thereof can be incorporated into a hydrogel. The alpha-emitting radioactive gel may be infused internally for treatment of sarcomas, carcinomas and prostate disease, or may be used for external treatment of Kaposi's Sarcoma, or other diseases. Actinium-225, Bismuth-213, or mixtures thereof can also be combined with compounds that are not targeted at specific cells, such as styrenes, or styrene polymers, acrylic polymers, biodegradable, or bioerodable materials such as hydrogels, or other products that can be formed into a colloidal dispersion or particulate form and may then used for radiation synovectomy.

By incorporating releasable therapeutic drugs in a radioactive polymer or gel, this invention also aims to provide for the optimization of post-procedure management to improve the efficacy and safety of patient treatment.

a. Preparation of a Pharmaceutical Composition

Generally, the preparation of the radionuclide pharmaceutical preparation will depend on the route of administration and the condition being treated. However, general guidelines are presented here. These guidelines are equally applicable for radionuclides complexed with targeting molecules, described below.

Examples of pharmaceutical compositions include a radionuclide, or chelated radionuclide, or a chelated radionuclide attached to a targeting molecule, in some embodiments by a linker, or any other composition including a radionuclide of the present invention, along with a pharmaceutically acceptable carrier, diluent, excipient, or vehicle. Suitable pharmaceutically acceptable carriers, diluents, excipients, and vehicles include, but are not limited to, neutral buffered saline or saline. Additionally, the pharmaceutical composition may contain other constituents, including for example buffers, carbohydrates such as glucose, sucrose, or dextrose, preservatives, as well as other stabilizers or excipients.

Methods for preparing such formulations are well known. A formulation may be in the form of a suspension, injectable solution or other suitable formulation. Physiologically acceptable suspending media, with or without adjuvants, may be used. The formulations of the present invention are in the solid or liquid form containing the active radionuclide, and optionally the chelator/linker/targeting agent. These formulations may be in kit form such that the two components (i.e. chelator, radionuclide, linker, and targeting agent) are mixed at the appropriate time prior to use. Whether premixed or as a kit, the formulations may include a pharmaceutically acceptable carrier.

Other examples of kits include kits for incorporating Actinium-225, Bismuth-213, or mixtures thereof into a steroid group, an aryl group, a substituted aryl group, a vinyl group, an isothiocyanate, or an isocyanate group capable of coupling with antibodies. Similarly, Actinium-225, Bismuth-213, or mixtures thereof can be incorporated into an aromatic amine, an aromatic isocyanate, an aromatic carboxylic acid, an aromatic isothiocyanate, benzoic acid, a substituted benzoic acid group, or a vinylestradial group. Any person could make use of such a kit, including a researcher, a pharmacist, a doctor, or even the end user, the patient.

For injectable compositions, the present invention may be either in suspension or solution form. In solution form the complex (or when desired the separate components) is dissolved in a physiologically acceptable carrier. Such carriers generally comprise a suitable solvent, preservatives such as benzyl alcohol, if needed, and buffers. Useful solvents include, for example, water, aqueous alcohols, glycols, and phosphonate or carbonate esters. Such aqueous solutions generally contain no more than 50 percent of the organic solvent by volume.

Injectable suspensions are compositions of the present invention including a liquid suspending medium, with or without adjuvants, as a carrier. The suspending medium may be, for example, aqueous polyvinylpyrrolidone, inert oils such as vegetable oils or highly refined mineral oils, or aqueous carboxymethylcellulose. Suitable physiologically acceptable adjuvants, if necessary to keep the complex in suspension, may be chosen from among thickeners such as carboxymethylcellulose, polyvinylpyrrolidone, gelatin, or alginates. Many surfactants are also useful as suspending agents, for example, lecithin, alkylphenol, polyethylene oxide adducts, napthalenesulfonate, alkylbenzenesulfonates, and the polyoxyethylene sorbitan esters. Many substances which effect the hydrophobicity, density, and surface tension of the liquid suspension medium may be used in injectable suspensions in individual cases. For example, silicone antifoams, sorbitol, and sugars are all useful suspending agents.

The radionuclide may be formulated into vehicles for topical administration, and such vehicles also include solutions, but may additionally include gels, lotions, creams, or salves. Where necessary, the radionuclide may be formulated into an oral dosage form, the types of which are too numerous to list. Essentially, there is no limit to the method of administration, as long as the radionuclide can be effectively delivered to the site of interest.

Actinium-225, Bismuth-213, or mixtures thereof can be incorporated into a hydrogel. An alpha-emitting radioactive gel may be infused internally for treatment of sarcomas, carcinomas and prostate disease, or may be used for external treatment of Kaposi's Sarcoma, or other diseases. Actinium-225, Bismuth-213, or mixtures thereof can also be combined with nonspecific compounds, such as styrenes, or styrene polymers, acrylic polymers, biodegradable, or bioerodable materials such as hydrogels, or other products that can be formed into a colloidal dispersion or particulate form and may then used for radiation synovectomy. By incorporating releasable therapeutic drugs in a radioactive polymer or gel, this invention also aims to provide for the optimization of post procedure management to improve the efficacy and safety of patient treatment.

b. Administration

An "effective amount" of the formulation is used for therapy. The dose will vary depending on the disease being treated. Although in vitro diagnostics can be performed with the formulations of this invention, in vivo diagnostics are also contemplated using formulations of this invention.

Although appropriate dosages may be determined by experimental trials, about $5\times10^{10}$ to $5\times10^{11}$ conjugate complexes/70 kg of adult weight may be administered assuming an approximate 1:1 ratio of targeting agent to the alpha-emitter. Nevertheless, the amount and frequency of administration will depend, of course, on many factors such as the condition of the patient, the nature and severity of the disease, as well as the condition being treated. In addition, it may be desirable to first mask pre-deliver the targeting agent, without radionuclide, in order to minimize non-specific binding, and damage to normal healthy tissues.

2. Use Linked to a Targeting Agent

Generally, it may be desirable to attach the radionuclide to a different material in order to specifically target a part of a person's or animal's body. For example, in order to target the radionuclide to a cancer, the radionuclide may be linked to a material that specifically interacts with that cancer, and not with other parts of the body. Examples of applications in which the radionuclide may be attached to another material include treatment and diagnosis of all types of cancer, and many other diseases.

For synthesis of labeled organic molecules, the Actinium-225 can be passed through a cation-exchange column to remove salts and trace metals prior to labeling. It is preferable for labeling of organic compounds, such as proteins, monoclonal antibodies, and natural products, that the radionuclide solutions be as chemically pure as possible.

The targeting agent may be used solely to carry to the radionuclide to the site of interest, or may have pharmacological activity of its own. For example, Actinium-225 and Bismuth-213 produced in accordance with the invention may be used in the treatment of AML Leukemia. In this embodiment, Actinium-225 or Bismuth-213 are attached to an anti-angiogenesis agent for adjuvant therapy. Such agents include, but are not limited to, endostatin, angiostatin and combrestatin.

Other specific examples of targeting agents, with and without their own pharmacological activity, are described below.

a. Targeting Agent

The radionuclides of the present invention may be carried to their destination by attaching them to a targeting agent. Targeting agents include those agents that have a specific affinity, for example, to a molecule, or to a subcellular structure such as a receptor. These targeting agents carry the radionuclide to the specific destination. Alternatively, the targeting agent could be administered first, followed by the radionuclide, thereby catching and holding the radionuclide. The targeting agent usually holds the radionuclide in place until the radionuclide decays. Thus, the interaction of the targeting agent with the target usually lasts longer than the half-life of the radionuclide.

There are a number of examples of agents that may be used as targeting agents. Useful targeting molecules include, but are not limited to, proteins and enzymes generally, including monoclonal antibodies, prostate secretory proteins, as well as statins, taxol, tamoxifen, taxene, and estrogen receptor modifiers. The possibilities are limitless, and for the sake of brevity, details are provided for only a few.

i. Antibodies

Antibodies that may be linked to radionuclides of the present invention include monoclonal and polyclonal antibodies. Monoclonal antibodies are immunoglobulins of well-defined chemical structure, in contrast to polyclonal antibodies, which are heterogeneous mixtures of immunoglobulins. A characteristic feature of monoclonal antibodies is reproducibility of function and specificity, and such antibodies can be and have been developed for a wide variety of target antigens, including tumor cells. Chimeric monoclonal antibodies and fragments have been prepared by recombinant techniques (Morrison, S. L., Hospital Practice (Office Edition), 65–80 (1989)).

Methods for obtaining monoclonal antibodies or fragments have been extensively discussed and are well-known in the art. 20 Such methods are detailed in Monoclonal Antibodies (R. H. Kennett, T. J. McKearn & K. B. Bechtol eds. (1980); see also Koprowski et al. (U.S. Pat. No. 4,196,265). The selection of a monoclonal antibody for the practice of this invention will depend upon the end use for which the radionuclide conjugated to the antibody will be employed. Such selection is within the skill of the art.

Specific examples include antibodies that are directed against a cancer. Antibodies raised against a known marker for a cancer may be used to target that cancer. Prostate specific antigen is one example of an antigen that may be targeted with antibodies raised to the antigen. In this manner the radionuclide is directed specifically to the targeted cancer, and the radionuclide is held at the site without non-specific distribution around the body. Other antigens that are known to be expressed by specific cancer cells may be targeted in this manner.

This embodiment may also be used to target foreign invaders, such as fungi, bacteria, or even viruses. Antibodies specific to these pathogens are well known in the art. By linking the radionuclide to such an antibody, the foreign pathogen can be killed by the radionuclide attached to the antibody that it binds.

Methods of producing antibodies are well known in the art. Such methods include, for example, harvesting antibodies from an individual afflicted with cancer, or infected with a foreign pathogen. After being isolated and purified, the antibody can be linked to the radionuclide and placed back into the host. Alternatively, antibodies can be raised against antigens in vitro, followed by isolation and purification, linking to a radionuclide, and introduction into a patient in need of treatment.

Antibodies that have been "humanized" may also be used as targeting molecules with radionuclides, in accordance with the present invention. Such antibodies are generally from an animal origin, but have been modified by replacing part of their structure with the equivalent structure from human antibodies. Antigen specificity is maintained, while immunogenicity to the antibody itself is decreased.

ii. Other Ligands

Another use of the radionuclides of the present invention relies on a target already present in a body, i.e., receptors. As is well known in the art, animals have many different kinds of receptors, for which natural and synthetic ligands are known. The examples are too numerous to list, but include examples such as steroid receptors and opioid receptors. Both natural and synthetic ligands are known for receptors, and by linking a radionuclide to these ligands, the receptors may be specifically targeted. This is especially important for conditions in which these receptors need to be targeted in a disease state.

In one embodiment, Bismuth-213, Actinium-225, or mixtures thereof can be attached to a PSP94 prostate secretory protein and its immunogenic peptides and targeted at prostate cancer.

As another example, receptors for regulatory peptides have been identified in a number of different cancer cell types. Examples of such peptides include, but are not limited to, somatostatin, vasoactive intestinal peptide, and cholecystokinin. By linking a radionuclide to a regulatory peptide, the cancer cell may be preferentially targeted.

Alternatively, radionuclides of the present invention may be conjugated to compounds recognized as growth factors. Like the other targeting molecules discussed above, the growth factor is chosen because it is capable of specifically binding to a defined population of cancer cells. Many growth factors known to one of ordinary skill in the art may be utilized within the present invention. Representative examples include platelet derived growth factors, transforming growth factor-beta, interleukins (ie., IL-1, IL-2, IL-3, IL-4, IL-5, IL-6, IL-7, IL-8, or IL-9), granulocyte-macrophage colony stimulating factor (GMCSF), erythropoietin, tumor necrosis factor, endothelial cell growth factor, platelet basic proteins, capillary endothelial cell growth factor, cartilage-derived growth factor, chondrosarcoma-derived growth factor, retina-derived growth factor, hepatoma derived growth factor, bombesin, and parathyroid hormone. Other growth factors include epidermal growth factor, transforming growth factor-alpha, fibroblast growth factors, insulin-like growth factor I and II, and nerve growth factor.

Growth factors are generally selected for their capacity to specifically bind to a defined population of cancer cells which include, for example, preneoplastic cells, premetastatic cells, and tumor cells (both benign and malignant). As will be understood by one of ordinary skill in the art, a defined population of cancer cells may generally be differentiated from normal cells based upon the greater number of growth factor receptors on the cell surface.

Alternatively, a radionuclide may be linked to a ligand for hormone receptors, to target cancer cells that express such hormone receptors. Ligands that are particularly suited for linking include hormones such as estrogens, or estrogen derivatives, androgens, and steroids. Cholesterol and diethylstilbestrol may be used in a similar manner. Other ligands that may be linked include drugs which are known to target such receptors. Tamoxifen and taxene are specific examples of ligands that may be used.

Specific ligands of interest that are not believed to fall within the above-identified categories include taxol and thalidomide.

b. Preparation—Attachment to a Targeting Agent

Linking the radionuclide to the molecules of interest is fairly easily accomplished using techniques known in the art. Examples of such techniques are discussed in U.S. Pat. No. 5,364,613, to Sieving et al., and U.S. Pat. No. 5,958,374, to Meares et al.

Because the radionuclide is generally in its molecular state, i.e., it is not covalently bonded to another molecule, it may be necessary to join the radionuclide in some other manner. Because the radionuclide is usually a charged metal, chelating is a good choice. Thus, the radionuclide may be chelated in a larger molecule.

The chelator may be covalently bonded to another functional moiety, such as a targeting agent. Thus, for example, a growth factor may be covalently bonded to a chelator, which is used to chelate the Actinium-225 or Bismuth-213. The radionuclide is then carried with the growth factor to its specific site in the body.

The targeting agent may be joined to the chelator in any manner, including through the use of a linker. Generally, a linker will be covalently bonded to the chelator on one "end" and the other "end" will have a moiety for reacting, and covalently bonding, with a targeting agent. The chelator and linker may therefore be viewed as one molecule, having a chelating moiety on one end, and a reactive moiety on the other.

Thus, to summarize, the radionuclide-containing composition may include 1) a chelator, 2) a linker, and/or 3) a targeting agent. In some embodiments, the chelator will act serve the role of targeting agent, and a separate targeting agent and linker will be unnecessary. Alternatively, a chelator may be covalently bonded directly to a targeting molecule, eliminating the need for a separate linker. The terms "chelator," "linker," and "targeting agent" are conceptual terms meant to simplify the understanding of the complex, and should not in any way be considered limiting. Thus, combinations in which the radionuclide is chelated within the targeting agent, combinations including multiple chelators, linkers, or targeting agents, or combinations lacking any chelator, linker, or targeting agent, are contemplated. All that is necessary is that a radionuclide of the present invention be included.

The radionuclide may be attached to a targeting molecule by two general procedures. In the first, a chelator is attached to a targeting agent, generally by a linker. The resulting conjugate then chelates the radionuclide. Alternatively, a linker may be bonded to a chelator, which is then pre-chelated by combining it with the radionuclide. The radionuclide/chelator/linker is then bonded to the target molecule.

i. Chelators

A variety of diverse organic macrocyclic complexing agents may be used to sequester the alpha-emitting radionuclide including, but not limited to, the following groups: (1) spherands, (2) cryptaspherands, (3) cryptands, (4) hemispherands, (5) corrands (modified crown ethers), and (6) podands (acyclic hosts) (see Cram, Science 240:760–67 (1988). In general, these macrocyclic ring compounds are large, somewhat spherical organic compounds which resemble cage structures, and have the ability to hold a heavy radionuclide as a ligand holds a metal ion.

The chelator should be selected such that it has both a high affinity and specificity for the alpha-emitting radionuclide as well as a low intrinsic mammalian toxicity. High specificity avoids displacement by other divalent cations ($Mg^{+2}$ and $Ca^{+2}$) that are prevalent in physiological fluids. Additionally, the compound should either contain a functional group, or have chemistry which is compatible with the introduction of an appropriate functional group, to allow attachment to the linker.

The affinity of the chelator for the alpha-emitting radionuclide is defined by the system energetics as described by Cram (supra). More specifically, as inferred by X-ray crystallographic data of complexed and non-complexed crown ethers, it is believed that the solution conformations of non-complexed ethers lack well-defined cavities with the associated convergently aligned binding sites. During the process of complexation, the crown ether undergoes desolvation and reordering of structure, a process which requires energy. If the chelator presents a rigid prestructured and desolvated cavity to the ion (as is the case for spherands), the energy normally consumed by desolvation and reorganization is reflected in a larger binding constant for the ion.

Based on this fundamental principle of reorganization, Cram lists the affinity of hosts for their most complimentary guests as: spherands>cryptaspherands>cryptands>hemispherands>corrands>podands. The difference in binding affinity between spherands and podands is dramatic, for example, the binding constant of a lithium chelating spherand was found to be 1012 higher than its corresponding open-chain podand (see Cram, supra). Thus, although many different chelators may be utilized within the context of the present invention, spherands which are designed and synthesized specifically to sequester Actinium-225 or Bismuth-213 are particularly preferred.

Particularly preferred chelators include 18-crown–6 or 21-crown-7 ethers, including for example modified crown ethers such as dicyclohexano-21-crown-7 (Case and McDowell, *Radioact. Radiochem.* 1:58 (1990); McDowell et al., *Solvent Extr. Ion Exch.* 7.377 (1989); for other crown ethers or macrocyclic polyethers, see Pedersen, *Science* 241:536–540 (1988); U.S. Pat. No. 4,943,375, Eia et al.; *Heterocycles* 32(4):711–722 (1991); Wai and Du, *Anal. Chem.* 62(21):2412–14 (1990); Tang and Wai, *Analyst (London)* 114(4):451–453 (1989)). Briefly, $Ac^{2+}$ is bound by the etherate oxygen network comprising the interior cavity of the spherical crown-ether molecule. This binding is believed to be pH dependent: $Ac^{2+}$ complexes with a combination of a proton and smaller Group IA ions for the binding site within the crown cavity. These crown ethers may additionally be modified with polarizable functional groups (similar to changes made with closo- and nido-carboamyl species used in boron-neutron capture therapy), resulting in compounds with greater solubility in aqueous media (see generally, Mizusawa et al., *Inorg. Chem.* 24:1911 (1985)). Such changes improve retention of biological specificity after conjugation, and improve the conjugate loading capability of the biological agent. These modifications may be accomplished in tandem with the synthesis of the above-noted crown ethers under appropriate conditions for mild conjugation to the biological delivery system.

Additional crown ethers suitable for use within the present invention may be synthesized, or purchased from various sources including, among others, Aldrich Chemical Co. (Milwaukee, Wis.), Fluka Chemical Corp. (Ronkonkoma, N.Y.), and Nisso Research Chemicals, (Iwai Co. Ltd., Tokyo, Japan). Chelation of the alpha-emitting radionuclide may be achieved by mixing the chelator with a salt of the alpha-emitting radionuclide which has been dissolved in solvent. The particular solvent chosen depends of course on the solubility of the chelator and alpha-emitting radionuclide. For example, Cram and co-workers prepared the sodium complex of a spherand simply by adding excess salt dissolved in acetonitrile to a methylene chloride solution of the spherand (see Cram and Lein, *J. Am. Chem. Soc.* 107:3657–3668 (1985)).

The ability of the crown ether to sequester or complex with the alpha-emitting radionuclide may be readily determined (see Cox et al., "Rates and Equilibria of Alkaline-Earth-Metal Complexes with Diaza Crown Ethers in Methanol," *Inorg. Chem.,* 27:4018–4021 (1988); see also Mohite and Khopkar, "Separation of Barium From Alkaline Earths and Associated Elements by Extraction with Dibenzo-18-crown-6 From a Picrate Medium," *Analytica Chimica Acta,* 206:363–367 (1988)). Briefly, separation of the complexed and free radionuclide can be accomplished by partitioning between an organic solvent (such as chloroform) and water. The complexed radionuclide will partition into the organic phase, whereas the free radionuclide will reside exclusively in the aqueous phase. Alternatively, a variety of chromatographic techniques such as High Performance Liquid Chromatography (HPLC) or Reverse-Phase High Performance Liquid Chromatography (RP-HPLC) may be utilized to separate chelated radionuclide from the free cation.

Once isolated, verification of the molecular architecture may be accomplished. Briefly, the mode of cation binding can take two forms: (1) through external association (ie., anion/cation pairing without bond formation), or (2) via coordination of the cation to the crown-ether oxygen network. Specificity and strong binding, which are preferred for the present applications, are dependent on the latter type of association. Single crystal X-ray diffraction techniques may be used to unambiguously assign the type of interaction for the solid materials, and $^{17}O$, $^{13}C$ and $^{1}H$-NMR may be used to determine the structures of target materials in solution.

Other chelators capable of chelating radionuclides include polyaza- and polyoxamacrocycles. Examples of polyazamacrocyclic moieties include, but are not limited to, those derived from compounds such at 1,4,7,10-tetraazacyclododecane-N,N',N",N'"-tetraacetic acid (herein abbreviated as DOTA); 1,4,7,10-tetraazacyclotridecane-N,N',N",N'"-tetraacetic acid (herein abbreviated as TRITA); 1,4,8,11-tetraazacyclotetradecane-N,N',N",N'"-tetraacetic acid (herein abbreviated as TETA); and 1,5,9,13-tetraazacyclohexadecane-N,N',N",N'"-tetraacetic acid (abbreviated herein abbreviated as HETA). Other chelators include linear or branched chelating moieties including, but are not limited to, those derived from compounds such as ethylenediaminetetraacetic acid (herein abbreviated as EDTA) and diethylenetriaminepentaacetic acid (herein abbreviated as DTPA).

In other embodiments, a chelator may have a pharmaceutical application simply by its chelation of the radionuclide. For example, the chelated radionuclide my result in greater specific uptake by certain parts of the body than would be observed for the radionuclide delivered alone.

ii. Linkers

Generally, however, the chelated radionuclide will be linked to a targeting agent. Linking the chelated radionuclide to the targeting agents is generally a matter of simple chemistry between reactive groups. The linker provides a covalent bridge between the chelator and the targeting agent. Ideally, the linker does not interfere with the ability of the chelator to sequester the radionuclide, or with the ability of the targeting agent to properly interact with its specific target. These goals are achieved in a variety of different ways.

When the chelating moiety is macrocyclic, the linker may be attached to any annular atom. For example, when the chelating moiety is a polyazamacrocycle, the linker may be attached to an annular carbon atom or an annular nitrogen atom. When the linking moiety is attached to an annular nitrogen atom, the compound may be referred to as an N-substituted polyazamacrocycle. Chelating moieties having carboxylic acid groups, such as DOTA, TRITA, HETA, HEXA, EDTA, and DTPA, may be derivatized to convert one or more carboxylic acid groups to amide groups, and thereby provide a point of attachment to the chelator.

The other end of the linker, i.e., the end for attachment to the targeting agent, includes a functional group that will facilitate that attachment. Functional groups capable of covalently binding to targeting molecules include, but are not limited to, those functional groups which can be activated by known methods, so as to be capable of covalently binding to targeting molecule(s). For example, the formation of active esters (—C(=O)OR, wherein R is, for example, succinimidyl) from carboxylic acids, the formation of acid halides (—C(=O)X, wherein X is typically Cl or Br) from carboxylic acids.

The functional group(s) present on the linker which are capable of covalently binding to targeting agent may be chosen according to the targeting agent to which the chelating agent will ultimately be bound. Reactive pairs of functional groups permit conjugation of the chelating moiety with the targeting molecule, via the linker moiety, wherein one member of the pair is present on the chelating agent and the other member of the pair is present on the targeting molecule. For example, when the targeting molecule is a protein possessing a free amino (—$NH_2$) group, a functional group such as isothiocyanate (—NCS) present on the linker permits reaction to form a joining linkage (in this case, a thiourea linkage), thereby forming a chelating agent-linker-targeting molecule complex. Other examples of appropriate reactive pairs of functional groups include, for example, —NH2 with —C(=O)OR (active ester) or with —C(=O)OC(=O)R (anhydride) or with —C(=O)X (acid halide) to yield an amide linkage; —$NH_2$ with —NCO (isocyanate) to yield a urea linkage. Other reactive pairs involving —$NH_2$ include —$NH_2$ and —$S(=O)_2X$ (sulfonyl halide); —$NH_2$ and —C(=NR)OR (imidate ester); and —$NH_2$ and —OC(=O)X (haloformate). Examples of reactive pairs of functional groups include —SH and —$C(=O)CH_2X$ (haloacetyl) to yield a —$SCH_2$ C(=O)— linkage; —SH and -alkyl-X (alkyl halide) or —SH and —S(=O)O-alkyl (alkyl sulfonate) to yield a thioether; and —SH and —SH (sulfhydryl) to yield a —SS— (disulfide) linkage.

The purpose of the "linker" is to attach the chelator to the targeting agent. If, however, the chelator includes a reactive functionality to which the targeting agent can attach, then a separate "linker" molecule may be unnecessary. For example, if the chelator includes an isothiocyanate (—NCS), and the targeting agent includes an amino (—$NH_2$), then the chelator can be attached directly to the targeting agent. Any such combination may be used, and the need for a separate linker molecule eliminated. However, the close proximity of the chelator to the targeting agent should not compromise the ability of either moiety to perform its role. For example, the chelator should still be able to effectively sequester the radionuclide, and the targeting agent should be able to interact with its biological target. If these purposes might be compromised, a longer linker molecule may be used.

For example, in an embodiment of the present invention in which the targeting agent is a polymer of amino acids (e.g., peptide, polypeptide, protein, etc.), the alpha-emitting radionuclide is positioned within a chelator, which is in turn coupled by a linker to the amino ("N") or carboxy ("C") terminus of the targeting agent. The linker may act to place an inert "spacer" between the biologically active targeting agent and the alpha-emitting radionuclide containing complex. This space minimizes steric interactions that may interfere with the targeting agent's affinity toward its target. The optimum length of the spacer arm is primarily dependent on the affinity of the targeting agent for its target. The higher this affinity, the smaller the relative importance of stearic repulsion between the chelator and the target receptors. A virtually limitless number of linkers may be selected which are suitable for use within the present invention, and this list includes disulfides, dicarboxylic acids, polycarbon chains, and modified polycarbon chains. Linkers may include hydrocarbon chains which range in length from 4 to 18 carbon atoms. Linkers may have six or more methylene units, such as hexamethylene diamine.

The linker may be attached to any of a number of extraanular functionalities on the chelator, including carboxy and amino functionalities. Within one aspect of the invention, if the extraanular functionalization is a carboxy group, then a first synthetic step may involve reaction of the chelator with hexamethylene diamine. Subsequent reaction with the C-terminus of the targeting agent would complete synthesis of the conjugate.

Alternatively, as noted above, the linker may be coupled to other aspects of the growth factor such as the N-terminus. Within this embodiment, after reaction with hexamethylene diamine the chelator may be reacted with succinic anhydride. Subsequent coupling of the linker to the targeting agent may then be accomplished through the N-terminus of the targeting agent.

Alternatively, within another aspect of the present invention, the chelator may contain an amino functionality. In these cases, a dicarboxylic acid linker (for example, octanedioic acid) may be utilized to couple the chelator to the N-terminus of the targeting agent. On the other hand, if the chelator is reacted with ethylene diamine after condensation with the dicarboxylic acid, linkage to the targeting agent may be accomplished through the C-terminus.

Specific examples of useful compounds include CHX DTPA-A and CHX DTPA-B. Methods for making these compounds are described in U.S. Pat. Nos. 5,286,850, 5,124,471, and 5,434,287. As used herein, DTPA CHX-A and DTPA CHX-B are used synonymously with CHX DTPA-A and CHX DTPA-B.

Additional methods for attaching radionuclides to targeting molecules are found in WO 93/09816. Other methods are described in U.S. Pat. Nos. 4,923,985, 5,286,850, 5,124,471, 5,428,154 and 5,434,287 to Gansow et al.

c. Preparation of a Pharmaceutical Composition

The preparation of the radionuclide pharmaceutical preparation described above for "neat" compositions applies equally to compositions in which the radionuclide is used with a targeting agent. That information will not be repeated here.

d. Administration

An "effective amount" of the formulation is used for therapy. The dose will vary depending on the disease being treated. Although in vitro diagnostics can be performed with the formulations of this invention, in vivo diagnostics are also contemplated using formulations of this invention.

Although appropriate dosages may be determined by experimental trials, about $5\times10^{1}$ to $5\times10^{11}$ conjugate complexes/70 kg of adult weight may be administered assuming an approximate 1:1 ratio of targeting agent to the alpha-emitter. Nevertheless, the amount and frequency of administration will depend, of course, on many factors such as the condition of the patient, the nature and severity of the disease, as well as the condition being treated. In addition, it may be desirable to first mask pre-deliver the targeting agent, without radionuclide, in order to minimize non-specific binding, and damage to normal healthy tissues.

3. Use Linked to a Non-Targeting Agent

In addition to linking the radionuclide to an agent which serves to target a specific part of the body, the radionuclide may be linked to another cell toxin, to increase the cell killing efficacy. For example, the radionuclide may be linked to an antineoplastic agent, increasing its efficacy.

Antineoplastic agents work by the general mechanism that they are toxic to cells. However, these drugs are taken up to a greater extent by the more rapidly growing cancer cells. The antineoplastic effect can be made even more pronounced by linking the antineoplastic agent to a radionuclide. Such antineoplastic agents include, but are not limited to, vicristine, vinblastine, methotrexate, cisplatin, fluorouracil, oxyuridine, and adriamycin.

4. Other Routes of Delivery

In addition to the routes of delivery described above, the compositions of the present invention may also be delivered from devices and/or implants. For example, the present compositions may be released from a battery-driven pump at a desired rate, for delivery to a site of interest. Alternatively, the present compositions may be formulated as extended-, prolonged-, or delayed-release formulations in polymeric vehicles.

Such formulations may be prepared as pellets or implants, which are placed into a targeted site for delivery. Alternatively, such polymeric compositions of the present invention could be coated onto devices such as stents or catheters for delivery to sites of interest. Such embodiments are particularly advantageous when the disease or lesion to be treated involves unchecked vascular proliferation, such as in restenosis.

Methods for making such polymeric formulations, and for making implants, and devices for drug delivery, are well known in the art, and are not restated here for purposes of brevity.

C. EXAMPLES

The following examples are presented as an illustration of one embodiment of the present invention. These examples should not be construed as limiting the claimed invention in any way.

Example 1

Preparing Converting Material

A milled Tungsten plate having the dimensions of 3 mm (width)×3 mm (height)×1 mm (thickness) is obtained. The plate is well sanded, washed with distilled water, and dried thoroughly.

Example 2

Coating Radionuclide onto Converting Material

A Nickel-plating solution is prepared by mixing nickel chloride (40–60 g/l), nickel sulfate (240–300 g/l), and boric acid (25–40 g/l). The pH is adjusted to approximately 3.5 to 5.0.

The Tungsten plate, prepared as described above, is then placed into the Nickel-plating solution in an electroplating apparatus with a Platinum electrode and Nickel is electroplated onto the Tungsten plate. Operating conditions are: temperature of 30–60° C., and current density of 2–7 A/dm$^2$. Agitation is performed with air.

The resulting nickel-plated substrate is then placed into a Radium-226 dioxide plating solution and electroplated with Radium-226. Briefly, sufficient Radium-226 is dissolved in 8 molar $NHO_3$ to form a 0.1 M Radium-226 solution. Cells for electroplating are constructed according to Krishnaswami and Sarin, (Krishnaswami, S., and M. M. Sarin (1976), *Anal. Chim. Acta,* 83, 143–156). A teflon stir bar is placed in the electroplating device. Limiting values of the power supply are set to 6 V and 0.8 A.

The device is placed on a stir plate in a fume hood. Stirring is started, and the power supply is current limited to 0.8 A. When sufficient plating has occurred, the plating should be terminated by disconnecting the power and adding concentrated ammonia. The electroplated target should be rinsed with distilled water and dried before proceeding. The Tungsten plate should be coated to a concentration of about 120 mg Radium-226/cm$^2$.

Example 3

Bombarding Target

The target, as prepared above, is ready for bombardment with a high-energy electron beam.

The target is placed in the path of an electron beam in a linear accelerator operating at 10 kW, and bombarded with high-energy electrons. The current of the electron beam is set for about 500 microampere. The energy of the electron beam impacting the target should be about 25 MeV. The target is bombarded for approximately 20 days, at a distance of 50 cm from the beam source.

The theoretical production yield calculation results are given in FIG. 1, where the production activities of Radium-225 and Actinium-225 are given as a function of irradiation time for a 1.0 gram Radium-226 target and a 25MeV electron beam. The values shown in FIG. 1 were obtained using the results shown in Table I, FIG. 2, and FIG. 3. Table I and FIG. 2 present the gamma flux/spectrum produced by both 20 MeV and 25 MeV electrons. FIG. 3 gives the curve for the Radium-226 (gamma, n) cross-section as a function of energy.

TABLE I

| Energy (MeV) of gamma (upper bin) | GAMMA FLUX 20 MeV e- Flux gamma/cm^2/MeV/e- 20 MeV e- phi | GAMMA FLUX 25 MeV e- Flux gamma/cm^2/MeV/e- 25 MeV e- Phi |
|---|---|---|
| 1 | 6.92E-01 | 6.64E-01 |
| 2 | 2.18E-01 | 2.12E-01 |
| 3 | 1.13E-01 | 1.15E-01 |
| 4 | 7.64E-02 | 7.64E-02 |
| 5 | 5.30E-02 | 5.48E-02 |
| 6 | 3.87E-02 | 4.26E-02 |
| 7 | 3.01E-02 | 3.38E-02 |
| 8 | 2.51E-02 | 2.75E-02 |
| 9 | 2.17E-02 | 2.28E-02 |
| 10 | 1.67E-02 | 1.96E-02 |
| 11 | 1.52E-02 | 1.64E-02 |
| 12 | 1.39E-02 | 1.48E-02 |
| 13 | 1.10E-02 | 1.28E-02 |
| 14 | 8.25E-03 | 1.12E-02 |
| 15 | 6.20E-03 | 9.81E-03 |
| 16 | 5.10E-03 | 8.84E-03 |
| 17 | 3.05E-03 | 7.91E-03 |
| 18 | 2.30E-03 | 6.86E-03 |
| 19 | 1.30E-03 | 5.86E-03 |
| 20 | 3.50E-04 | 5.02E-03 |
| 21 | | 3.63E-03 |
| 22 | | 2.58E-03 |
| 23 | | 1.93E-03 |
| 24 | | 1.21E-03 |
| 25 | | 3.40E-04 |

Higher specific activities can be achieved by moving the target closer to the converter, and higher total activities can be produced by using a thick wedge of material.

Generally, electron disintegration cross sections are about 100 times smaller than photodisintegration cross sections. Since electrons can be converted into photons with>50% efficiency at energies of 20 MeV or higher, it is desirable to work with the bremsstrahlung radiation. The bremsstrahlung dose rate in the forward direction is a function of electron energy when an optimum target is used. It should be noted that production rates in an electron accelerator do not increase much above 25 MeV as the "giant resonance" peak for the target is near 15 MeV (See FIG. 3).

Example 4

Separation and Purification of Actinium-225

The materials, including Radium-226, Radium-225, and Actinium-225, on the target, are dissolved from the Tungsten plate by use of a solution containing equal parts 5 M NaOH and 30% $H_2O_2$. After the materials are dissolved from the plate, the solution is neutralized by addition of sufficient HCl to bring the pH to about 7.

The entire solution is dried, and re-dissolved in a solution of 0.03 M $HNO_3$. The dissolved sample is passed over an LN® resin column (Eichrom Industries, Inc., Darien, Ill.) Radium-225 and Radium-226 will pass through with the effluent, and remaining Radium is washed from the column with 0.03M $HNO_3$. Bound Actinium-225 is eluted from the column with 0.35M $HNO_3$.

Example 5

Preparation of Actinium-225 Composition for Administration (Complexing with Targeting Molecule)

The Actinium-225 in 0.35 M $HNO_3$ is passed over a cation-exchange column to separate any unwanted salts, and to purify the radionuclide prior to complexation.

a. Preparation of BOC-p-nitro Phenylalanine Transcyclohexyldiamine Monoamide

Dissolve the BOC acid, N-hydroxysuccinamide, and EDC (48 mmol) in ethyl acetate (400 mL). The mixture is stirred for 12 hours. The reaction solution is filtered, and the filtrate is washed sequentially with saturated salt solution, lM HCl, 5% $NaHCO_3$, and saturated salt solution (200 mL each). The organic layer is separated and dried over $MgSO_4$. After filtering, the solution is rotary evaporated to a solid. The solid is taken up in DMF (200 mL) and added dropwise to trans-1,2-diaminocyclohexane over a period of 18 hours.

The precipitated diamide is filtered off, and the solution is rotary evaporated to a thick oil. The residue is taken up in chloroform and washed, as above, to remove any of the starting materials. The chloroform solution is dried as before, filtered, and concentrated to a gel-like consistency. This material is poured onto a Buchner funnel and triturated with petroleum ether to leave the product as a light tan solid.

b. Preparation of p-Nitrobenzyl-"CHX" Diethylenetriamine

The BOC group is cleaved by stirring the amide (4.6 g) overnight in dioxane (300 mL) saturated with HCl. Addition of diethyl ether (200 mL), followed by cooling to 4° C., adds significant precipitate. The dihydrochloride is collected on a Buchner funnel under argon and vacuum dried.

The amide dihydrochloride is suspended in THF (50 mL) in a three neck round bottom flask held in an ice bath. The flask is in fitted with a condenser, thermometer, and a septum. Diborane/THF (6 equivalents) are injected into the flask, and the temperature is raised to 50° C. and maintained there until the reduction is complete. The progress of the reaction is monitored by HPLC using a ten minute gradient of 100% 0.1M HOAc in water to 100% 0.1M HOAc in methanol. The column is a Waters DeltaPak C18.

After the reaction is finished, the solution is cooled to room temperature, and methanol (50 mL) is added to decompose any excess hydride. The solution is taken to dryness on the rotary evaporator, and the residue is taken up in 100% ethanol (100 mL). This solution is taken to dryness using a high vacuum rotary evaporator. Dioxane (150 mL), previously saturated with HCl, is added to the solid and the suspension as refluxed for four hours. The final suspension is left at 4° C. for 18 hours. The product is collected on a Buchner funnel under argon and then vacuum dried.

c. Preparation of p-Nitrobenzyl CHX DTPA

The triamine (1.0 g, 2.49 mmol) is dissolved in DMF (25 mL) 5 with sodium carbonate (1.992 g), and tert-butyl bromoacetate (2.915 g, 14.95 mmol) is added. The solution is heated to about 80° C. overnight under argon after which the reaction mixture is poured into $H_2O$ (100 mL) and extracted with $CH_2Cl_2$ (100 mL). The organic layer is washed with water (3×100 mL), separated, dried over $MgSO_4$, filtered, and rotary evaporated to an oil. The oil is further concentrated to a thick oil by high vacuum rotary evaporation.

The oil is treated with TFA (25 mL) overnight. The excess reagent is removed by rotary evaporation. Preparative HPLC is performed to separate and collect the two major peaks. After completion of the pre-HPLC, the HPLC buffer is removed by ion-exchange chromatography (AG50 W×8 200/400 mesh H+ form). The two fractions are labeled as CHX-A or CHX-B.

d. Preparation of p-Aminobenzyl CHX DTPA-A, -B

Atmospheric hydrogenation of each fraction is performed using 100 mg of each nitro compound with 10% Pd/C (100 mg) at pH 8.5. The reaction is allowed to proceed until the $H_2$ uptake halts. The reaction mixture is filtered on a fine frit with Celite 577. The filtrate is lyophilized to leave an off-white residue.

e. Preparation of p-Isothiocyanatobenzyl CHX DTPA-A, -B

Each fraction is dissolved in $H_2O$ (5 mL) and treated with thiophosgene (20 uL) in $CHCl_3$ (10 mL) with maximum stirring under argon for two hours. The organic layer is removed by room temperature rotary evaporation, and the aqueous layer is lyophilized to leave an off-white solid.

f. Final Complexation

The reactive CHX DTPA-A (-B could be used as well) is to dissolved in phosphate buffered saline. Equal molar ratios of Actinium-225 are dissolved into the buffer solution. Monoclonal antibody raised against prostate serum antigen is then added in an equal molar ratio. The mixture is mixed for 4 hours at 4° C., followed by anion exchange to remove any unbound Actinium-225.

Example 6

Administration of Actinium-225 Linked to Targeting Molecule

About $5\times10^{10}$ radionuclide complexes is dissolved in a one-milliliter volume of sterile saline solution. The solution is mixed into one liter of sterile lactated Ringers solution, which is then administered intravenously over one-half hour.

Example 7

Production of Bismuth-213 a. Extraction

Actinium-225 from Examples 4 and 5 above is placed in a 20-ml bottle and dried. This Actinium-225 is referred to as the "cow." A 3M anion exchange disc is pretreated with 0.5M HCl by placing the acid in a syringe, locking or attaching the disc to the syringe, and by pushing down on the syringe plunger, forcing the acid through the membrane. The pre-wash acid is discarded.

A volume of 10 ml of 0.5M HCl is drawn into a pipettor and ejected into into the "cow" storage bottle, allowing the Actinium-225 to dissolve in the solution. A pre-treated 3M filter is attached to the syringe outlet with an appropriate plastic micropipette tip attached to the outlet side of the 3M filter. Through the plastic tip, the dissolved "cow" containing the Actinium-225 and its daughters (including Bismuth-213) is pulled into the syringe up through the 3M anion exchange filter and up into the syringe barrel.

The plastic tip is removed, as is the Bismuth-213-loaded 3M anion exchange disc. The Actinium-225–0.5M HCl solution is ejected from the syringe into the original bottle, to be reused.

b. Washing

The Bismuth-213 product has now absorbed onto the 3M anion exchange disc, as has minor traces of Actinium-225 and HCl (which adhere to the interstitial surfaces of the resin). A new syringe is attached to the Bismuth-213-loaded anion exchange disc and a 0.005M HCl wash solution is pulled up through the disc. The disc is then removed and the acid wash, containing traces of interstitial "cow" solution, is expelled into a waste bottle. The "waste" HCl is discarded.

c. Bismuth-213 Elution

A solution of 0.05M NaOAc (pH 5.5) is drawn into a new syringe. The washed Bismuth-213-loaded 3M disc is attached to the syringe, and the solution of 0.05M NaOAc (pH 5.5) is ejected through the loaded disk and into a collection bottle.

Example 8

Preparation of Bismuth-213 Composition for Administration (Complexing with Targeting Molecule)

The reactive CHX DTPA-A (prepared as described in Example 5, above) is dissolved in acetate buffer, pH 6.0. An equal molar ratio of Bismuth-213 is dissolved into the buffer solution. Monoclonal antibody raised against prostate serum antigen is then added in an equal molar ratio. The mixture is mixed for 4 hours at 4° C., followed by cation exchange to remove any unbound Bismuth-213.

Example 9

Administration of Bismuth-213 Linked to Targeting Molecule

About $5\times10^{10}$ radionuclide complexes is dissolved in a one-milliliter volume of sterile saline solution. The solution is mixed into one liter of sterile lactated Ringers solution, which is then administered intravenously over one-half hour.

In summary, this invention is a reliable method for obtaining greater than 1000-millicurie quantities of Actinium-225/Bismuth-213 in <5-$\mu$Ci Radium-225/100 $\mu$Ci Actinium-225 radionuclide purity via bombardment of Radium-226. The Actinium-225/Bismuth-213 has physical properties that are useful for diagnostic and therapeutic radiopharmaceuticals, particularly when used for radioimmunotherapy.

The entire contents of all documents cited in this specification is a part of the present disclosure, and all documents cited herein are hereby incorporated by reference.

The foregoing detailed description has been given for illustration purposes only. A wide range of changes and modifications can be made to the preferred embodiment described above. It should therefore be understood that the following claims, including all equivalents, define the scope of the invention.

What is claimed is:

1. A method of producing an isotope comprising:

irradiating a converting material coated with coating material, the said coating material having an atomic number of n; the coated converting material comprising a target;

b) producing high-energy photons by directing high-energy electron beam at the said converting material;

c. interacting the photons with the coating material having an atomic number of n;

d. producing an isotope having an atomic number of n−1;

e. wherein the said coating material is in solid form or in liquid form.

2. The method of claim 1, further comprising:

a) irradiation is by directing electrons at the converting material;

b) n is 226, and the coating material having an atomic number n is Radium-226;

c) producing high-energy photons having energy of about 10 MeV to 25 MeV by directing high-energy electron beam having energy of about 20 MeV to about 25 MeV at the said converting material.

3. The method of claim 2, wherein n−1 is 225, and the isotope having an atomic number of n−1 is Radium-225.

4. The method of claim 3, wherein the converting material comprises at least one of Copper, Tungsten, Platinum and Tantalum.

5. The method of claim 4, wherein the converting material is coated with the coating material using electroplating.

6. The method of claim 5, wherein the converting material is electroplated with Nickel before being electroplated with Radium-226.

7. The method of claim 5, wherein the converting material is electroplated with Nickel and Radium-226 simultaneously.

8. The method of claim 5, wherein the Radium-226 is coated onto the converting material at a concentration of from about 80 $mg/cm^2$ to about 160 $mg/cm^2$.

9. The method of claim 4, wherein the electrons axe directed at the converting material coated with the coating material using an electron accelerator, and the electrons are in a beam.

10. The method of claim 9, wherein the converting material has a thickness of from about 0.5 mm to about 1.7 mm, and the electron beam has a current of from about 100 microampere to about 1000 microampere.

11. The method of claim 4, further comprising:

separating Actinium-225 from Radium-226 using a chemical separation.

12. A method of producing an isotope comprising:

a) electroplating a Tungsten converter material plate with Radium-226 coating material;

b) irradiating with a high-energy electron beam the said Radium-226 electroplated Tungsten converter material plate to produce high-energy photons;

c. producing Radium-225 from the interaction of photons with the Radium-226.

13. A method of claim 1 comprising:

a. forming a target from the converting material coated with a coating material;

b. directing electrons at the target;

c. producing photons from the interaction of the electrons with the target.

14. The method according to claim 13, wherein the liquid is contained.

15. The method according to claim 13, wherein the coating material is a liquid and is in contact with the converting material.

16. A method of claim 13 further comprising:

the target is a solid target.

17. The method of claim 16, wherein the solid target is a metal plate electroplated with Radium-226.

18. The method of claim 17, wherein the metal plate has an atomic number of 30 or higher.

19. The method of claim 18, wherein the metal is selected from the group of Tungsten, Tantalum, Platinum, and Copper.

20. A method of claim 13 further comprising:

the target composed of a metal plate coated with mixture of Radium-226 and Radium-225 and Actinium-225.

21. The metal plate of claim 20, wherein the metal is selected from Tungsten, Tantalum, Platinum, and Copper.

22. The method of claim 19, wherein the metal is Tungsten.

23. A method of claim 13 comprising the further steps of:

a. forming the coating material from Radium-226;

b. producing Radium-225 from interaction of photons with the Radium-226 target;

c. decaying Radium-225 to Actinium-225.

24. The method according to claim 15, wherein the coating material is flowed over the said converting material.

* * * * *